US007006654B2

(12) United States Patent
Stiles et al.

(10) Patent No.: US 7,006,654 B2
(45) Date of Patent: Feb. 28, 2006

(54) PUSH-PULL ELECTROMAGNETIC TRANSDUCER WITH INCREASED XMAX

(75) Inventors: Enrique M. Stiles, Imperial Beach, CA (US); Richard C. Calderwood, Portland, OR (US)

(73) Assignee: STEP Technologies, Inc., Minneapolis, MN (US)

( * ) Notice: Subject to any disclaimer, the term of this patent is extended or adjusted under 35 U.S.C. 154(b) by 301 days.

(21) Appl. No.: 10/360,033

(22) Filed: Feb. 7, 2003

(65) Prior Publication Data

US 2004/0156527 A1 Aug. 12, 2004

(51) Int. Cl.
*H04R 25/00* (2006.01)

(52) U.S. Cl. ..... 381/412; 381/400; 381/401; 381/421

(58) Field of Classification Search ..... 381/150, 381/190, 191, 400, 401, 412, 414, 419, 421, 381/420

See application file for complete search history.

(56) References Cited

U.S. PATENT DOCUMENTS 5,740,265 A * 4/1998 Shirakawa ..... 381/412
6,542,617 B1 * 4/2003 Fujihira et al. ..... 381/402
6,671,385 B1 * 12/2003 Suzuki et al. ..... 381/412
6,751,333 B1 * 6/2004 Azima et al. ..... 381/396

OTHER PUBLICATIONS

Ballou, Glen M., "Handbook for Sound Engineers" 2002, Focal Press, 3rd Edition, p. 502 and figure 17-24.*

* cited by examiner

*Primary Examiner*—Sinh Tran
*Assistant Examiner*—Brian Ensey
(74) *Attorney, Agent, or Firm*—Richard Calderwood

(57) ABSTRACT

An electromagnetic transducer such as an audio speaker, having an improved geometry in the positioning of its voice coils relative to its magnetic air gaps, facilitating a greater linear travel. The transducer has a push-pull geometry with at least two voice coils. At all positions throughout the linear travel region, less than 100% of the total voice coil windings are active, and less than 100% of the total available magnetic air gap height is active. As the voice coil assembly moves in one direction, the percentage of active windings or magnetic air gap is seamlessly handed off from the upper voice coil or magnetic air gap to the lower voice coil or magnetic air gap, and vice versa in the opposite direction. Some of the available voice coil windings and some of the available magnetic air gap height are left unused throughout the linear travel region, but, in exchange, the distance of the linear travel is dramatically increased.

34 Claims, 22 Drawing Sheets

Fig. 1 - prior art

Fig. 2 - prior art

Fig. 3 - prior art

Fig. 4 - prior art

PUSH-PULL ELECTROMAGNETIC TRANSDUCER WITH INCREASED XMAX

RELATED APPLICATIONS

This application is related to a co-pending application Ser. No. 10/289,109 entitled "Push-Push Multiple Magnetic Air Gap Transducer" and Ser. No. 10/289,080 entitled "Electromagnetic Transducer Having a Low Reluctance Return Path" filed Nov. 5, 2002 by co-inventor Enrique M. Stiles.

BACKGROUND OF THE INVENTION

1. Technical Field of the Invention

This invention relates generally to electromagnetic transducers such as audio speakers, and more specifically to a transducer having a geometry allowing greater linear travel and magnetic braking.

2. Background Art

Speakers are shown in cross-section in this document. Because speakers are generally cylindrically or rotationally symmetrical about an axis line or center line, only one side of any given speaker is shown, but the skilled reader will readily appreciate the three-dimensional structure which is thus represented. The reader will appreciate, however, that the invention is not limited to such axially symmetric implementations.

FIG. 1 illustrates a conventional audio speaker 10 such as is known in the prior art, shown as symmetrical about a center line CL. The speaker includes a magnetically conductive pole plate 12 which includes a pole 14 which may be either coupled to or integral with the base or back plate 16 of the pole plate, as shown. The pole may include an axial hole 18 for permitting airflow to cool the motor structure and depressurize the diaphragm assembly. A ring-shaped permanent magnet 20 surrounds the pole, with a cavity 22 between them. A magnetically conductive top plate 24 surrounds the pole, with a magnetic air gap 26 between them. Typically, the magnetic air gap will be smaller than the cavity. The pole plate, magnet, and top plate may collectively be termed a magnet assembly or a motor structure. The heavy black arrows denote exemplary directions of flux flow, throughout this document; the skilled reader will readily appreciate that the magnets may be reversed, and the flux will flow the opposite direction, and the transducer will operate correctly, especially when provided with an inverse phase electrical input signal.

An electrically conductive voice coil 28 is rigidly attached to a cylindrical bobbin or voice coil former 30. The voice coil is suspended within the magnetic air gap to provide mechanical force to a diaphragm 32 which is coupled to the bobbin. When an alternating current is passed through the voice coil, the voice coil moves up and down in the air gap along the axis of the speaker, causing the diaphragm to generate sound waves.

A frame 34 is coupled to the magnet assembly. There are two suspension components. A damper or spider 36 is coupled to the bobbin and the frame, and a surround 38 is coupled to the diaphragm and the frame. These two suspension components serve to keep the bobbin and diaphragm centered and aligned with respect to the pole, while allowing axial movement. A dust cap 40 seals the assembly and protects against infiltration of dust particles and other stray materials which might contaminate the magnetic air gap and thereby interfere with the operation or quality of the speaker.

When, as shown, the voice coil is taller (along the axis) than the magnetic air gap, the speaker is said to have an "overhung" geometry. If, on the other hand, the voice coil were shorter than the magnetic air gap, the speaker would be "underhung". If they are equal, the speaker is "equalhung".

If the voice coil moves so far that there exists a different number of voice coil turns within the air gap (i.e. an overhung voice coil has moved so far that one end of it has entered the air gap, or an underhung voice coil has moved so far that one end of it has left the air gap), the speaker begins to exhibit nonlinear characteristics, and the sound quality is distorted or changed. This is especially problematic when playing low frequency sounds at high volume, which require maximum voice coil travel.

The common approach to solving this problem has been to use highly overhung or highly underhung geometries to achieve a large amount of linear voice coil travel. These approaches have inherent limitations, however. The highly overhung motor requires increasingly longer coils, which in turn increases the total moving mass of the diaphragm assembly. At some point, this ever-increasing mass becomes so great that the inherent mechanical design limits are reached, which prevents any further controllable increase in travel. At the same time, increasing the voice coil mass with no resultant increase in utilized magnetic flux will reduce the overall efficiency of the transducer. Efficiency is proportional to BL squared, and inversely proportional to mass squared. In the highly underhung geometry, other practical limits are reached because of the relative increase in magnet area required to maintain a constant B across the magnetic gap height in order to achieve higher linear travel without sacrificing efficiency. Unfortunately, this increase in available magnetic flux does not result in an increase in BL, and therefore the transducer's efficiency also does not increase.

FIGS. 2–4 illustrate the prior art such as that taught in U.S. Pat. No. 4,783,824 to Kobayashi, which uses a "push-pull" geometry in which the magnetic flux over the top magnetic air gap travels in the opposite direction as the flux over the bottom magnetic air gap. This requires that the two voice coils be wound in opposite directions as indicated by the conventional "point" and "tail" markings, or that the voice coils be driven with opposite phase input signals, either of which complicates the manufacturing process.

The Kobayashi speaker 42 includes a center pole 44 which is mechanically coupled to an external shield 46 by a high magnetic reluctance spacer 48. A drive magnet 50 provides magnetic flux to an upper drive plate 52 and a lower drive plate 54, in opposite directions. A bucking magnet 56 is coupled between the shield and the lower drive plate, and helps cancel any stray flux that would otherwise escape the motor. An upper voice coil 58 rides in an upper drive magnetic air gap 60 between the center pole and the upper drive plate, and a lower voice coil 62 of opposite winding or phase rides in a lower drive magnetic air gap 64 between the center pole and the lower drive plate. The voice coils are wound around a bobbin 66 which is mechanically coupled to the diaphragm and other parts (not shown) of the diaphragm assembly.

Xmax may be interpreted to mean the one-way travel (typically expressed in terms of extension rather than retraction) over which the transducer exhibits a substantially constant, maximized BL. When the voice coil assembly moves too far in either direction, the active BL will begin to roll off, e.g. when the trailing end of an overhung voice coil begins to enter the magnetic air gap and less than the full gap is actively used. Xmax may alternatively be interpreted to include some greater distance than this, and is often interpreted to mean that distance over which the transducer exhibits no more than 10% distortion, or no more than 30% rolloff in active BL, or the like. In many instances in this document, we mean Xmax to mean the former (the maximum flat table-top portion of the BL curve), but the invention should not be interpreted to be narrowly limited to this case.

The maximum one-way linear travel (Xmax) can be observed as follows. The drive plates each have a thickness or height Hmg, while the voice coils each have a height Hvc. With the voice coil assembly at rest (not being electrically powered), the top of the upper voice coil is at a resting position Trest, as shown in FIG. 2. FIG. 3 illustrates that as the voice coil is driven outward to its maximum linear extension, where the bottom of each voice coil is just entering its magnetic air gap, the top of the upper voice coil has extended to a maximum extension point Tout. The distance from Trest to Tout is Xmax. FIG. 4 illustrates that as the voice coil is driven inward to its maximum linear retraction, where the top of each voice coil is just entering its magnetic air gap, the top of the upper voice coil has retracted to a maximum retraction point Tin. The distance from Trest to Tin is also Xmax, and the distance from Tout to Tin is Xtotal.

The maximum one-way linear travel for this speaker is $$X\max = \frac{Hvc}{2} - \frac{Hmg}{2}$$

or, in other words, $$X\text{total} = Hvc - Hmg$$

Throughout the linear operation range of prior art push-pull overhung speakers, it is always the case that 100% of the total height of available magnetic air gap is active and less than 100% of the total height of available voice coil is active. Throughout the linear operation range of prior art push-pull underhung speakers, it is always the case that 100% of the total height of available voice coil is active and less than 100% of the total height of available magnetic air gap is active.

Speakers may generally be classified as having an external magnet geometry (in which ring magnets surround a pole plate) or an internal magnet geometry (in which a cup contains magnets). Pole plates and cups may collectively be termed magnetic return path members or yokes, as they serve as the return path for magnetic flux which has crossed over the magnetic air gap.

Materials may be classified as either magnetic materials or non-magnetic materials. Non-magnetic materials may also be termed non magnetically conductive materials; aluminum and chalk are examples of non-magnetic materials. Magnetic materials are classified as hard magnetic materials and soft magnetic materials. Hard magnetic materials are also called permanent magnets, and generate magnetic flux fields without outside causation. Soft magnetic materials are those which, although not permanent magnets, will themselves become magnetized and conduct flux in response to their being placed in a magnetic field. Soft magnetic materials include the ferrous metals such as steel and iron.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

The invention may be utilized in a variety of magnetic transducer applications, including but not limited to audio speakers, microphones, mechanical position sensors, actuators (which can be linear motors), and the like. For the sake of convenience, the invention will be described with reference to audio speaker embodiments, but this should be considered illustrative and not limiting. The invention may prove especially useful in lightweight, low distortion, high excursion applications such as professional audio speakers, but, again, this should not be considered limiting.

Figure 5:
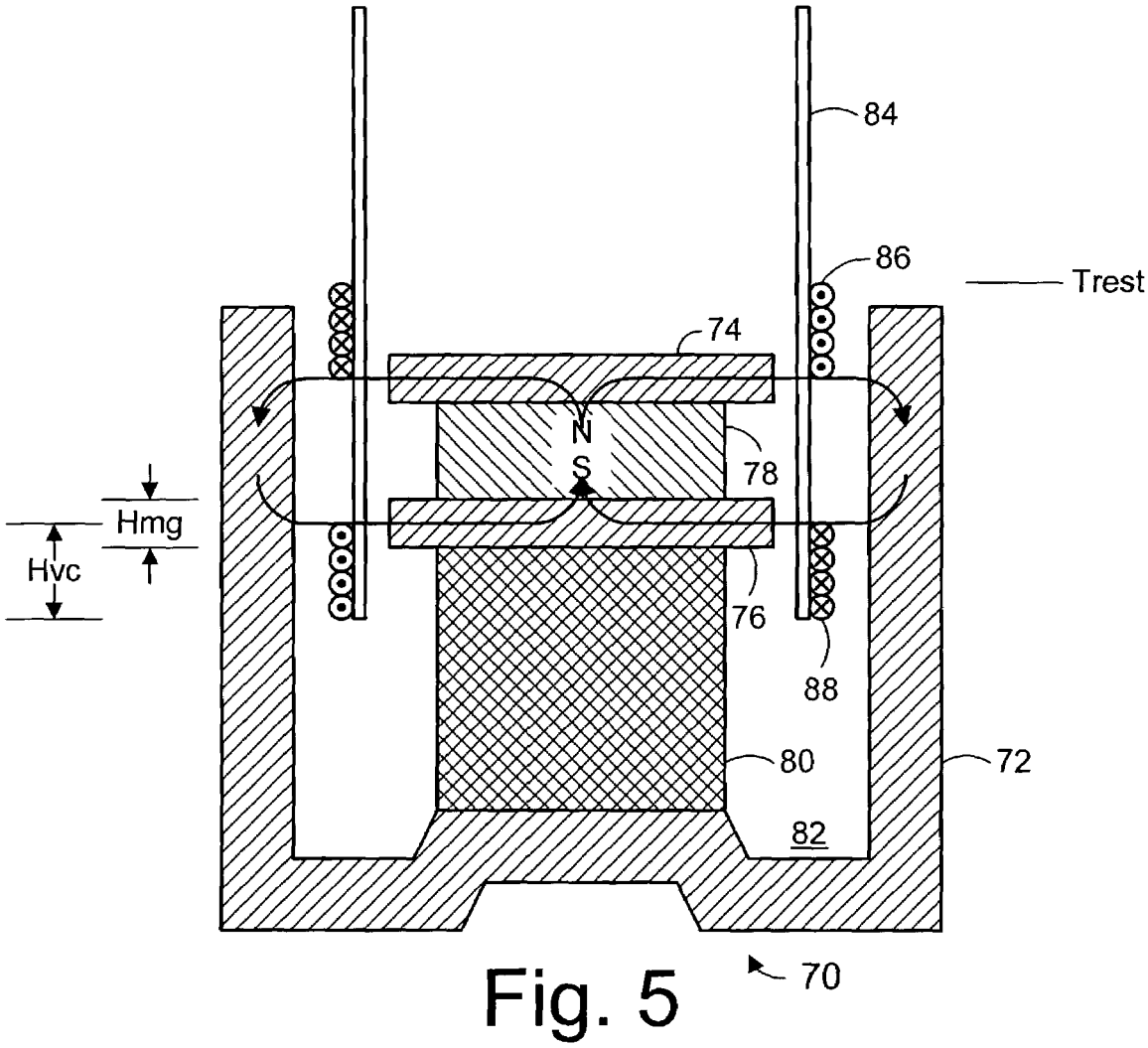
FIGS. 5–9 show, in cross-section, an internal magnet geometry semi-overhung voice coil embodiment of the push-pull electromagnetic transducer of this invention, specifically showing the middle resting point, maximum linear extension, start of magnetic braking at further extension, maximum linear retraction, and start of magnetic braking at further retraction of the voice coil, respectively.

FIG. 5 illustrates one embodiment of an internal magnet geometry electromagnetic transducer motor 70 according to this invention. The motor includes a magnetically conductive cup 72 which encompasses a magnet and plate assembly. The magnet and plate assembly includes a top drive plate 74 and a bottom drive plate 76 magnetically coupled to opposite sides of a magnet 78. In order to provide clearance at extreme voice coil retraction, the magnet assembly is mechanically coupled to the cup by a spacer 80 which may be a non-magnetically conductive material, such as aluminum. The cup may, optionally, further include a recess 82 or groove or cutout preventing the voice coil assembly from impacting the bottom inner surface of the cup at extreme retraction.

The motor structure includes a voice coil assembly which has a bobbin 84 to which are coupled a semi-overhung upper voice coil 86 and a semi-overhung lower voice coil 88. The configuration illustrated may be termed a "voice-coils-outside-plates" topology in that the voice coils extend outward over the outer boundaries of their respective drive plates.

Each drive plate has a height Hmg, and each voice coil has a height Hvc. At a centered position, the top of the upper voice coil is at a position Trest, the bottom edge of the upper voice coil is aligned with the center of the upper drive plate, and the top edge of the lower voice coil is aligned with the center of the lower drive plate. In other words, the distance between the inner edges of the voice coils is substantially equal to the thickness of one drive plate plus the magnet thickness (or, more accurately, plus the distance between the plates, as the magnet may not be the only component in this space). The at-rest position of the voice coil assembly may be adjusted to achieve less than optimally linear performance, in order to get alternative or unconventional acoustic results. The centered position is not necessarily the at-rest position, but may be defined as a position in which the voice coil assembly is positioned such that the active BL is split substantially equally between the push side and the pull side of the push-pull magnetic circuit.

Having the voice coils in this configuration, in which the voice coils occupy opposing halves of the respective magnetic air gaps, is a significant feature of semi-overhung embodiments of this invention, and allows for a greatly increased Xmax. At the centered position, 50% of each magnetic air gap is active (meaning it has voice coil windings in it). As the voice coils move axially, the usage of one of the magnetic air gaps decreases while usage of the other increases correspondingly, until one gap is unused and the other is 100% used. During this portion of the movement, the response is linear, because at all positions a total of one magnetic air gap's worth of voice coil windings are active, although they may partially reside in two different gaps. Then, during further movement in that same direction, the response remains linear until the outer, trailing edge of the active voice coil reaches the outer edge of its magnetic air gap.

Figure 6:
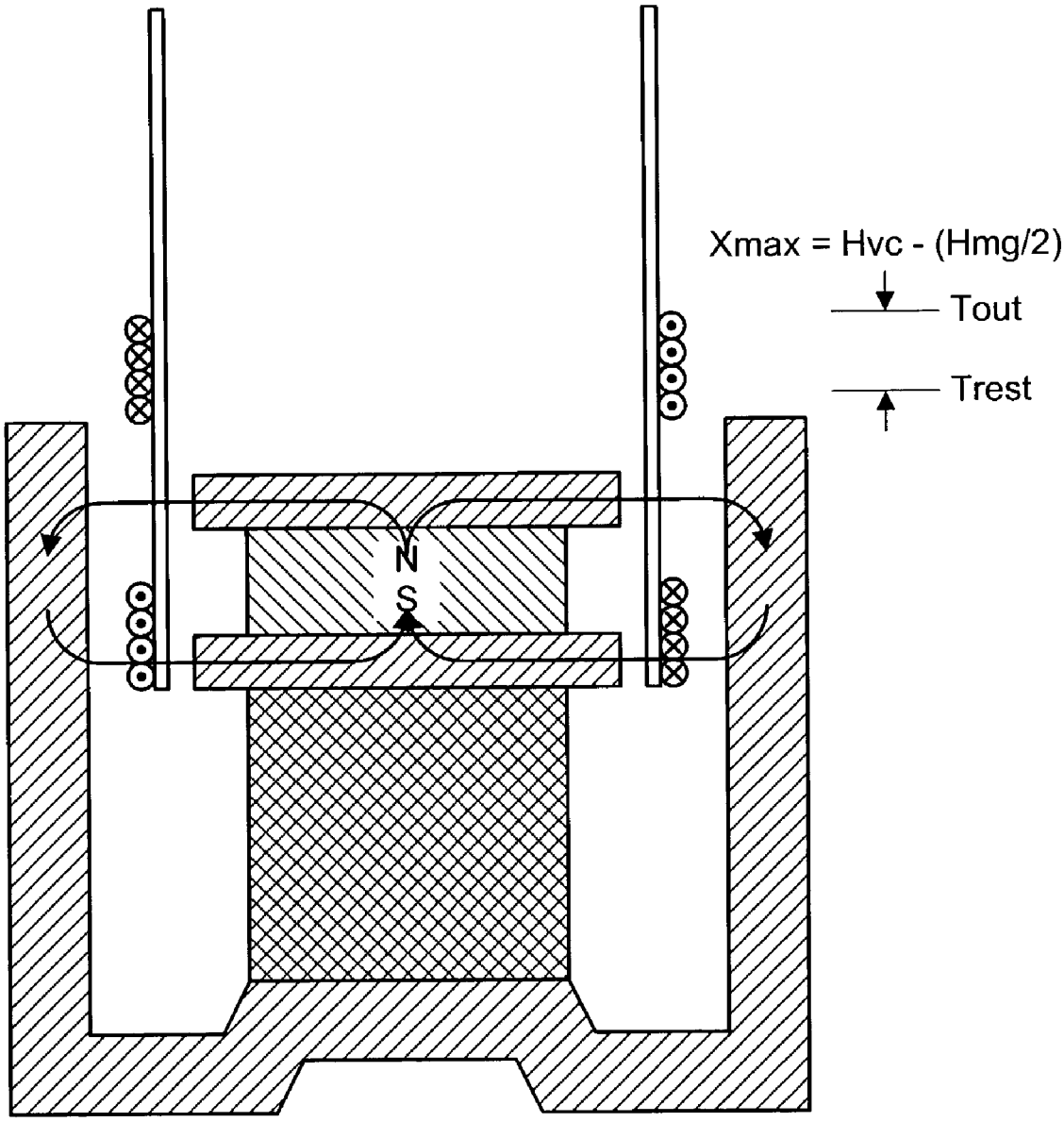

FIG. 6 illustrates the voice coil assembly at its point of maximum linear extension, when the bottom of the lower voice coil has just encountered the bottom of the lower drive magnetic air gap, and the top of the upper voice coil is at a position Tout. The distance from Trest to Tout is Xmax.

Figure 7:
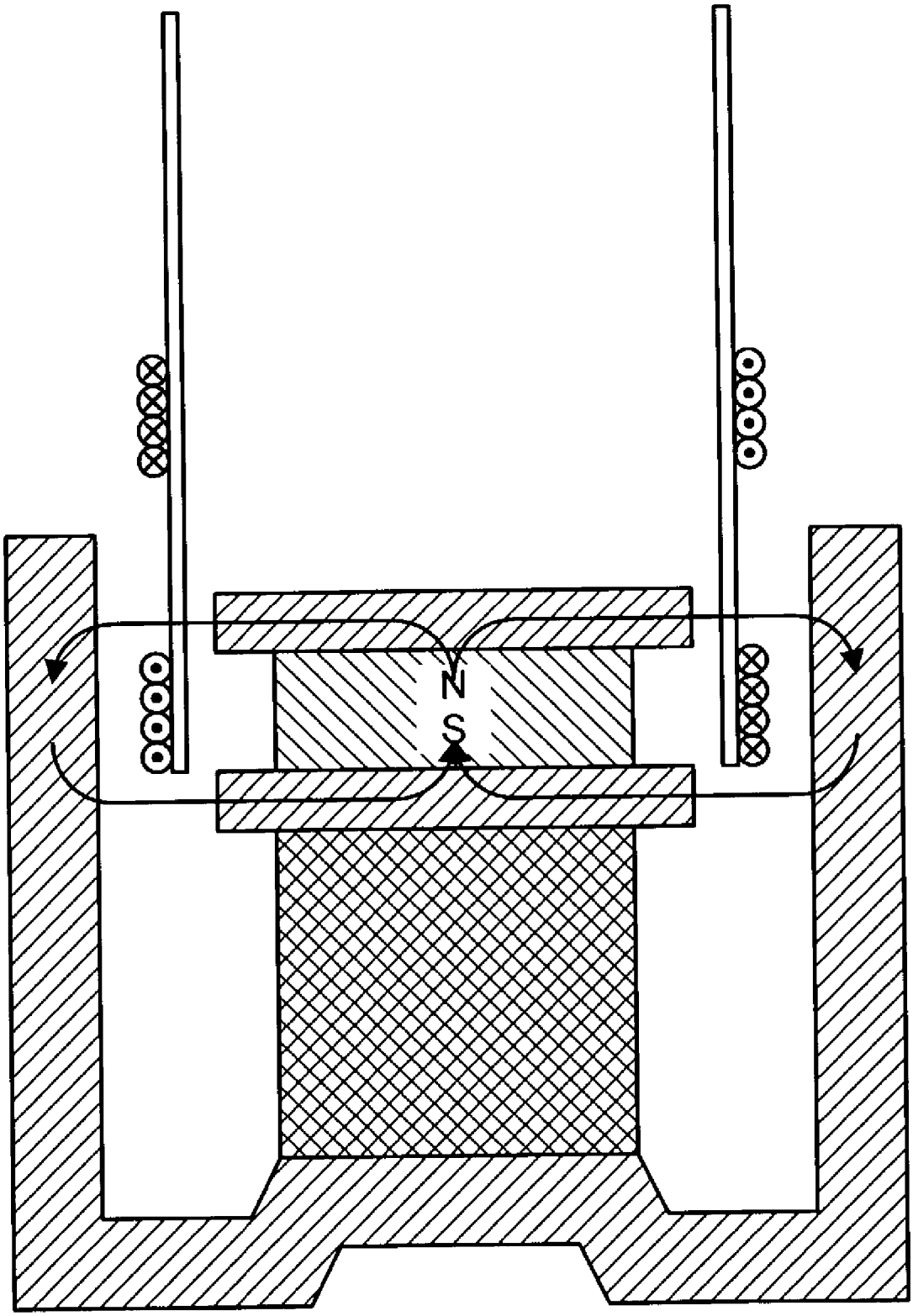

FIG. 7 illustrates the voice coil assembly having extended well beyond the limits of the linear drive region, to a point where magnetic braking begins as the lower voice coil begins to enter the upper drive magnetic air gap (which has its flux in the opposite direction as the lower drive magnetic air gap). From this point and outward, if the voice coils are still being powered by a constant phase signal, magnetic braking will try to force the voice coil assembly inward and thereby prevent overexcursion.

Figure 8:
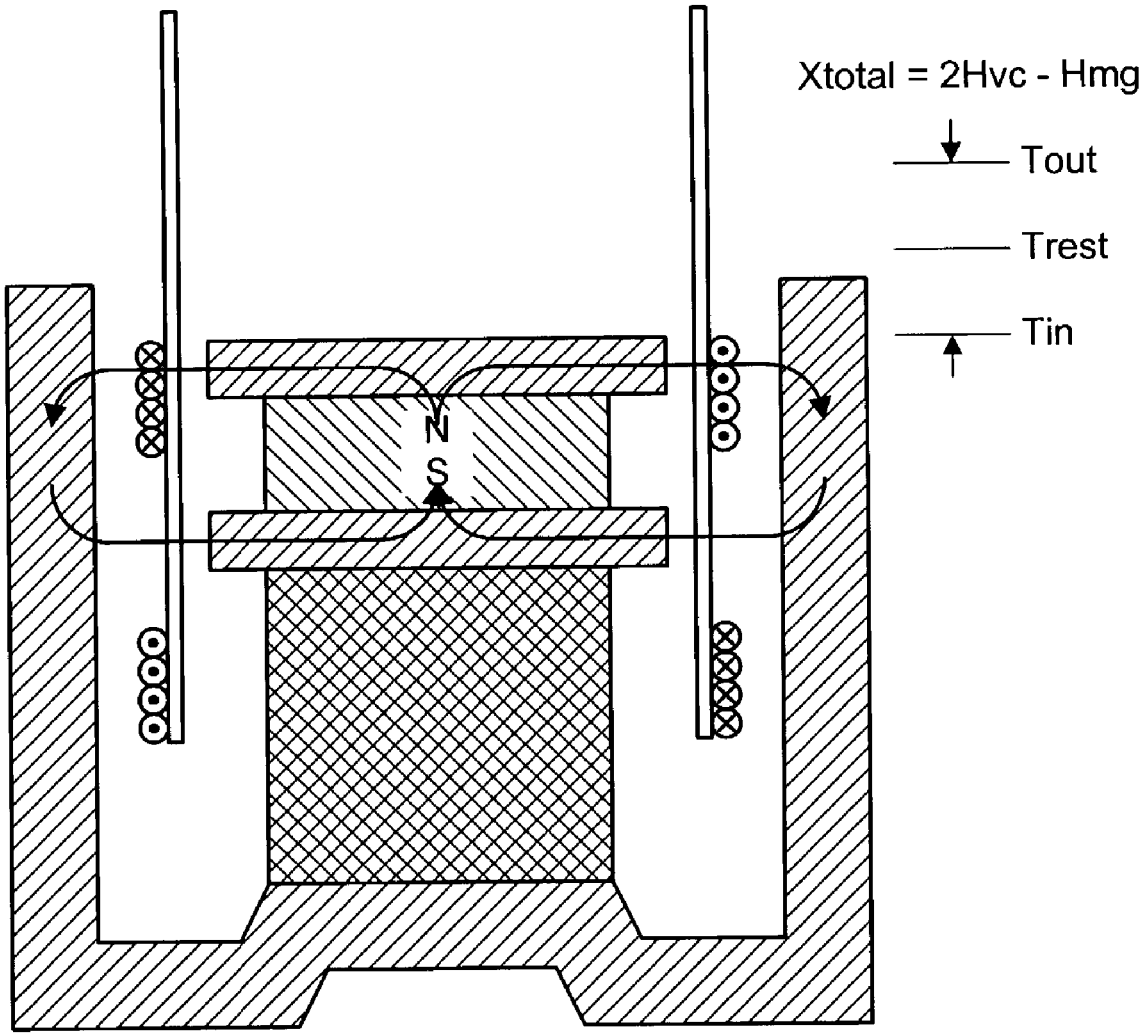

FIG. 8 illustrates the voice coil assembly at maximum linear retraction, when the top of the upper voice coil has just encountered the top of the upper drive magnetic air gap and is at a position Tin. The distance from Trest to Tin is also Xmax, and the distance from Tout to Tin is Xtotal.

The maximum one-way linear travel for this speaker is $$X\max = Hvc - \frac{Hmg}{2}$$

or, in other words, $$X\text{total} = (2 \cdot Hvc) - Hmg$$

The Xmax of this speaker is Hvc/2 better than that of the prior art speakers, and the Xtotal of this speaker is Hvc better than that of the prior art speakers.

Figure 9:
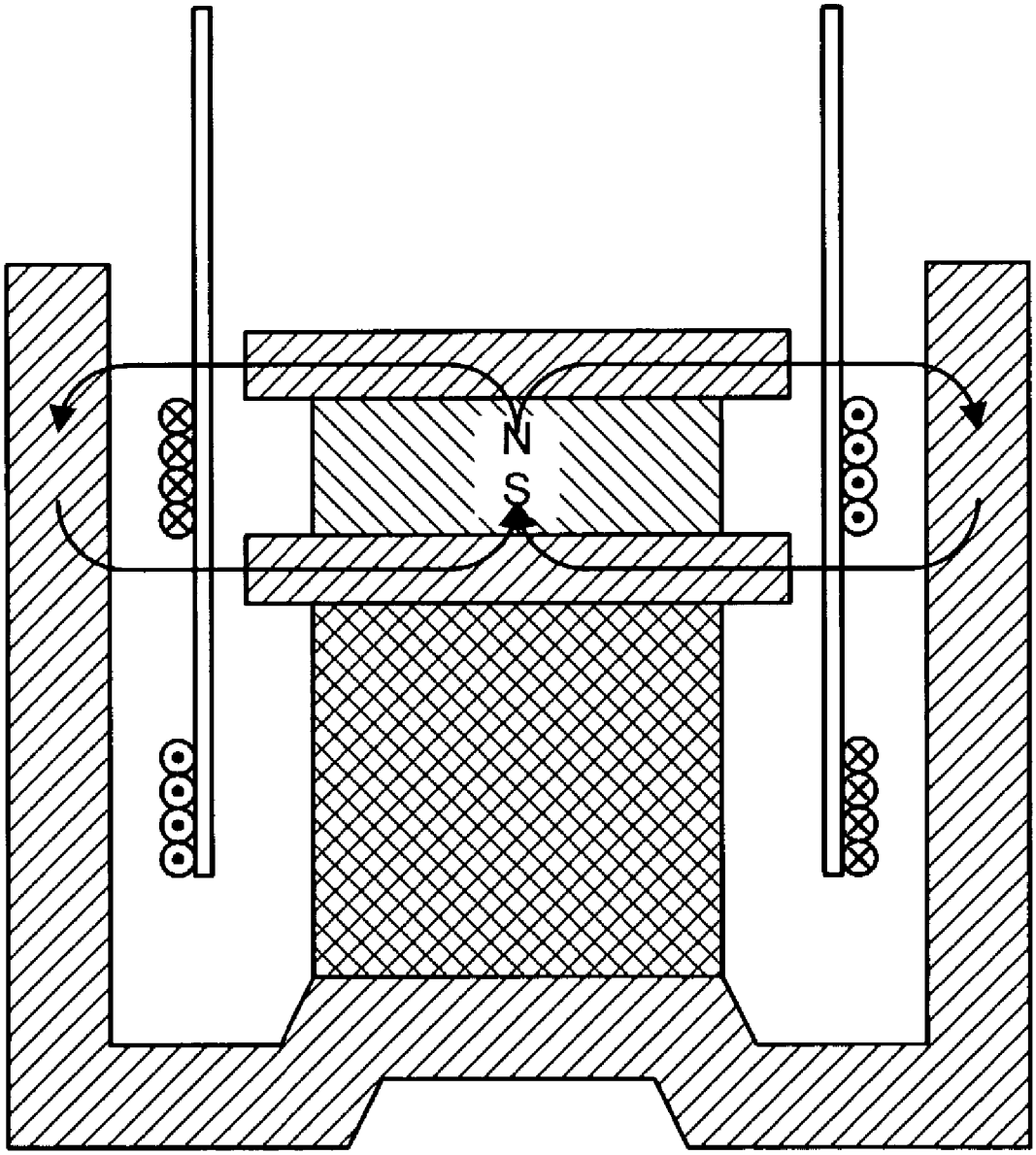

FIG. 9 illustrates the voice coil assembly having retracted until magnetic braking begins in this opposite direction.

Figure 10:
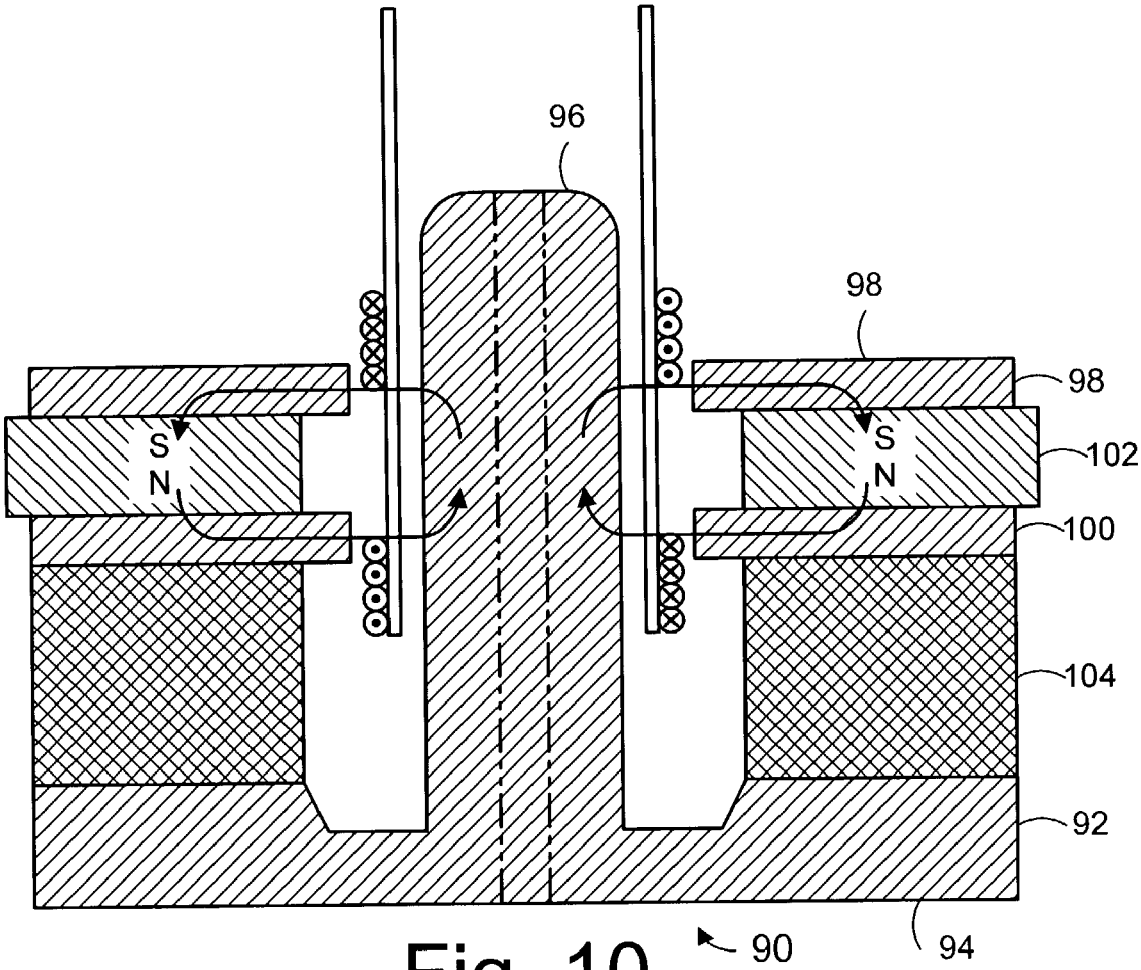
FIG. 10 shows, in cross-section, an external magnet semi-overhung voice coil geometry embodiment of the push-pull electromagnetic transducer of this invention.

FIG. 10 illustrates a external magnet geometry transducer motor 90 according to this invention, also using semi-overhung voice coils and the voice-coils-outside-plates topology. The motor has a pole plate 92 including a back plate 94 and a pole piece 96. The pole piece may be axially ventilated, as shown by the dashed lines. The motor includes a top drive plate 98 and bottom drive plate 100 coupled on opposite sides of an external ring magnet 102, and mechanically coupled to the back plate by a non magnetically conductive spacer 104 which takes the back plate and lower portion of the pole piece out of the push-pull magnetic circuit, to equalize the magnetic flux over the two magnetic air gaps.

Figure 11:
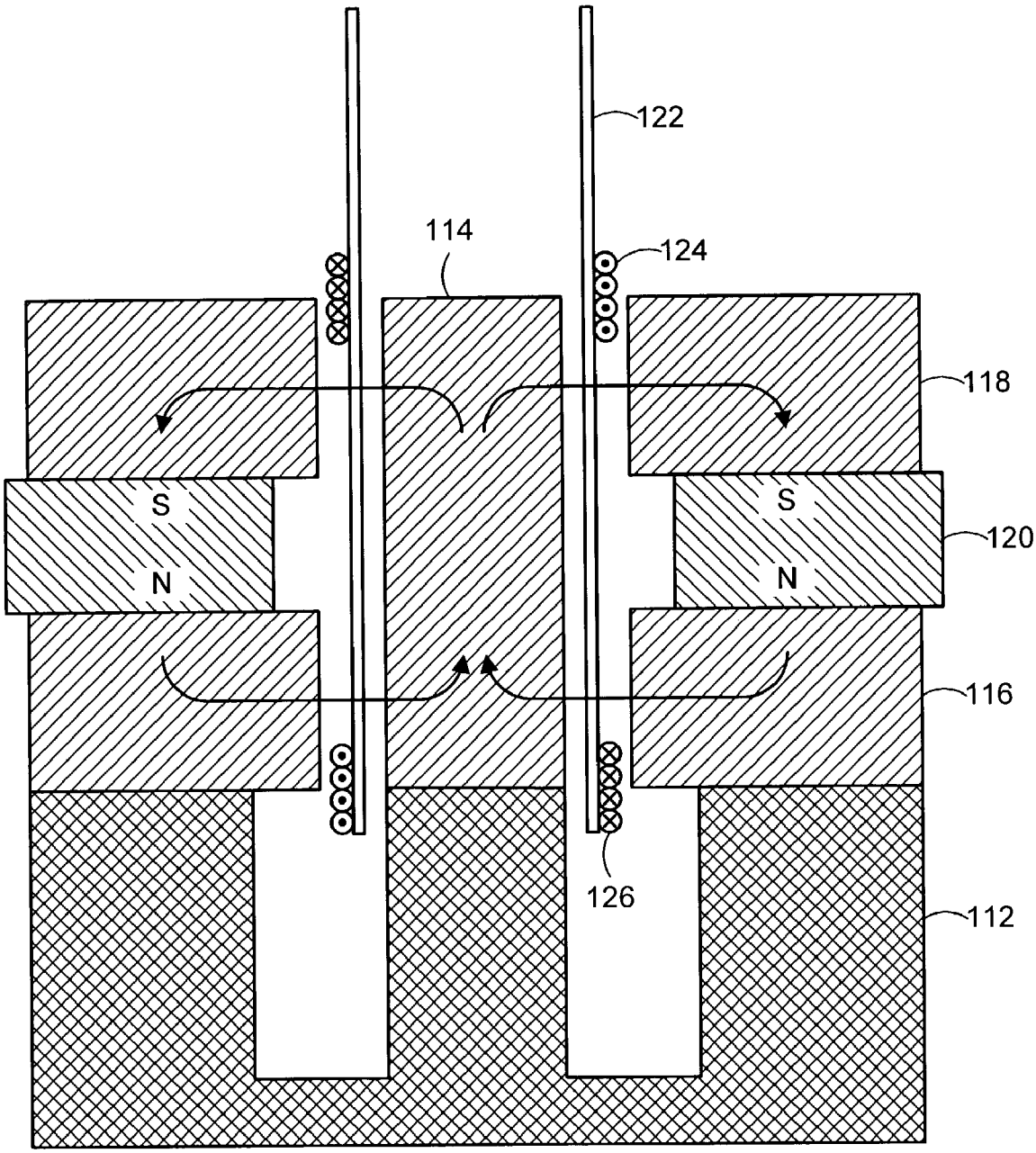
FIG. 11 shows, in cross-section, an external magnet semi-underhung voice coil geometry embodiment of the push-pull electromagnetic transducer of this invention.

FIG. 11 illustrates an embodiment of the invention using semi-underhung voice coils in a voice-coils-outside-plates topology and an external magnet motor geometry. The electromagnetic transducer 110 includes a non-magnetically conductive pole plate 112 to which is coupled a magnetically conductive pole piece 114. A lower ring plate 116 and an upper ring plate 118 are magnetically coupled to opposite sides of a ring magnet 120, and this stack is coupled to the pole plate. There are a variety of configurations which will allow sufficient retraction clearance for the voice coil assembly. As shown, the pole plate may include a deep recess. Alternatively, a spacer could be coupled between the pole plate and the lower plate.

The voice coil assembly includes a bobbin 122 to which are coupled a semi-underhung upper voice coil 124 and a semi-underhung lower voice coil 126. At the centered position, half the upper voice coil resides in the upper magnetic air gap, and half the lower voice coil resides in the lower magnetic air gap. As the voice coil assembly extends outward, less and less of the upper voice coil windings will be active, while more and more of the lower voice coil windings will be active, until the upper voice coil is inactive and the lower voice coil is 100% active. The motor structure will remain in linear operation until the top of the lower voice coil encounters the top of the lower magnetic air gap. As the voice coil assembly retracts from the centered position, less and less of the lower voice coil windings will be active, while more and more of the upper voice coil windings will be active, until the lower voice coil is inactive and the upper voice coil is 100% active. The motor structure will remain in linear operation until the bottom of the upper voice coil encounters the bottom of the upper magnetic air gap.

In voice-coils-outside-plates configurations, both voice coils are active in the early portion of linear travel and only the trailing voice coil is active in the latter portion of linear travel, when traveling from the centered position to either the extended or the retracted position.

Figure 12:
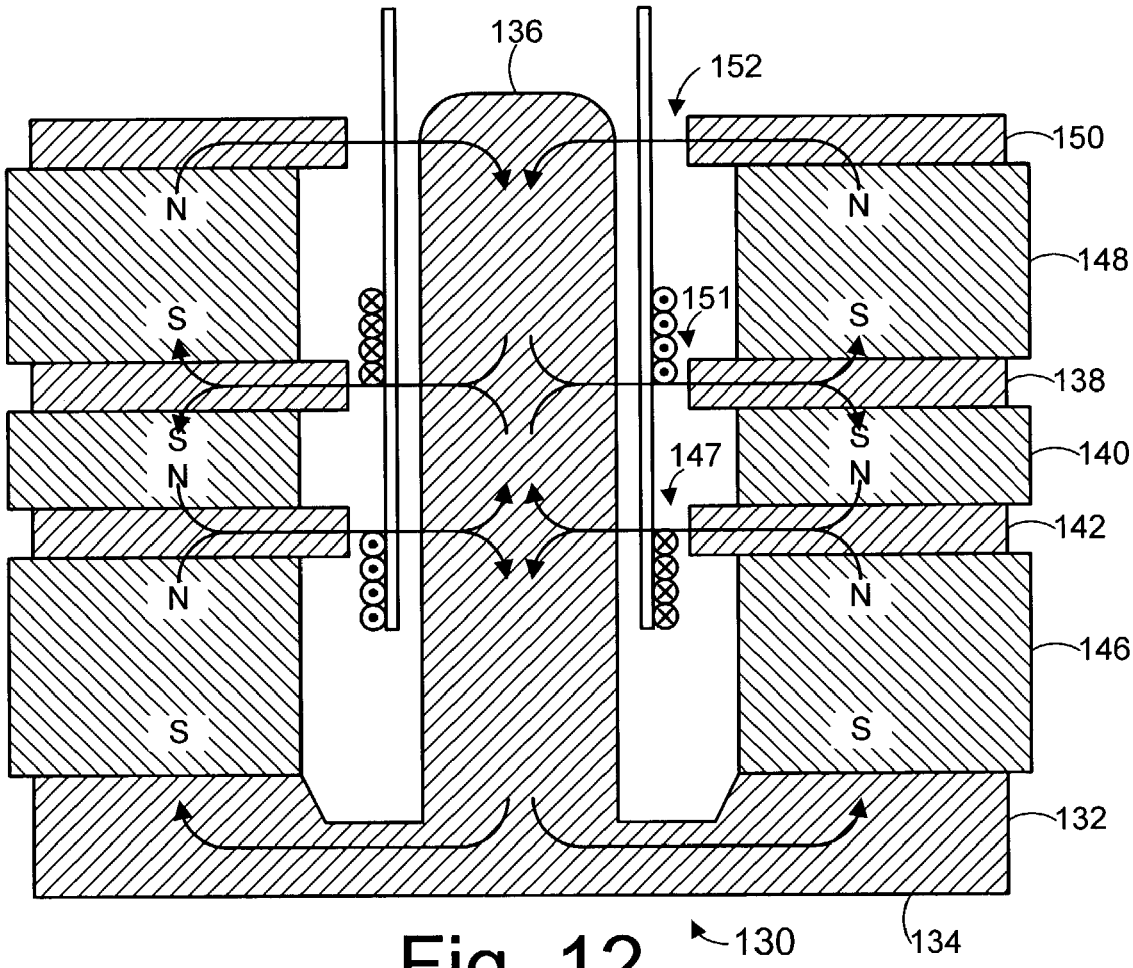
FIG. 12 shows, in cross-section, another external magnet semi-overhung voice coil embodiment of the invention, further including a low reluctance return path and bucking magnets to increase flux density over the push-pull drive magnetic air gaps.

FIG. 12 illustrates another embodiment of an electromagnetic transducer motor 130 with an external magnet geometry motor structure and a semi-overhung voice-coils-outside-plates configuration. The motor structure includes a pole plate 132 with a back plate 134 and a pole piece 136, an upper drive plate 138, a magnet 140, and a lower drive plate 142. Additionally, the motor structure includes an opposing polarity magnet 146 which couples the lower drive plate to the back plate and increase the amount of magnetic flux available to the lower magnetic air gap 147. The motor structure further includes a bucking magnet 148 coupled between the upper drive plate and a low reluctance return path plate 150. The bucking magnet provides additional magnetic flux to the upper magnetic air gap 151, to help achieve equal flux densities in both drive magnetic air gaps. The low reluctance return path plate defines a braking or non-driving magnetic air gap 152 over which magnetic flux flows between the return path plate and the pole piece. The return path plate not only improves the effectiveness of the bucking magnet, but it also provides an active braking zone for the upper voice coil at extreme extension of the voice coil assembly.

Figure 13:
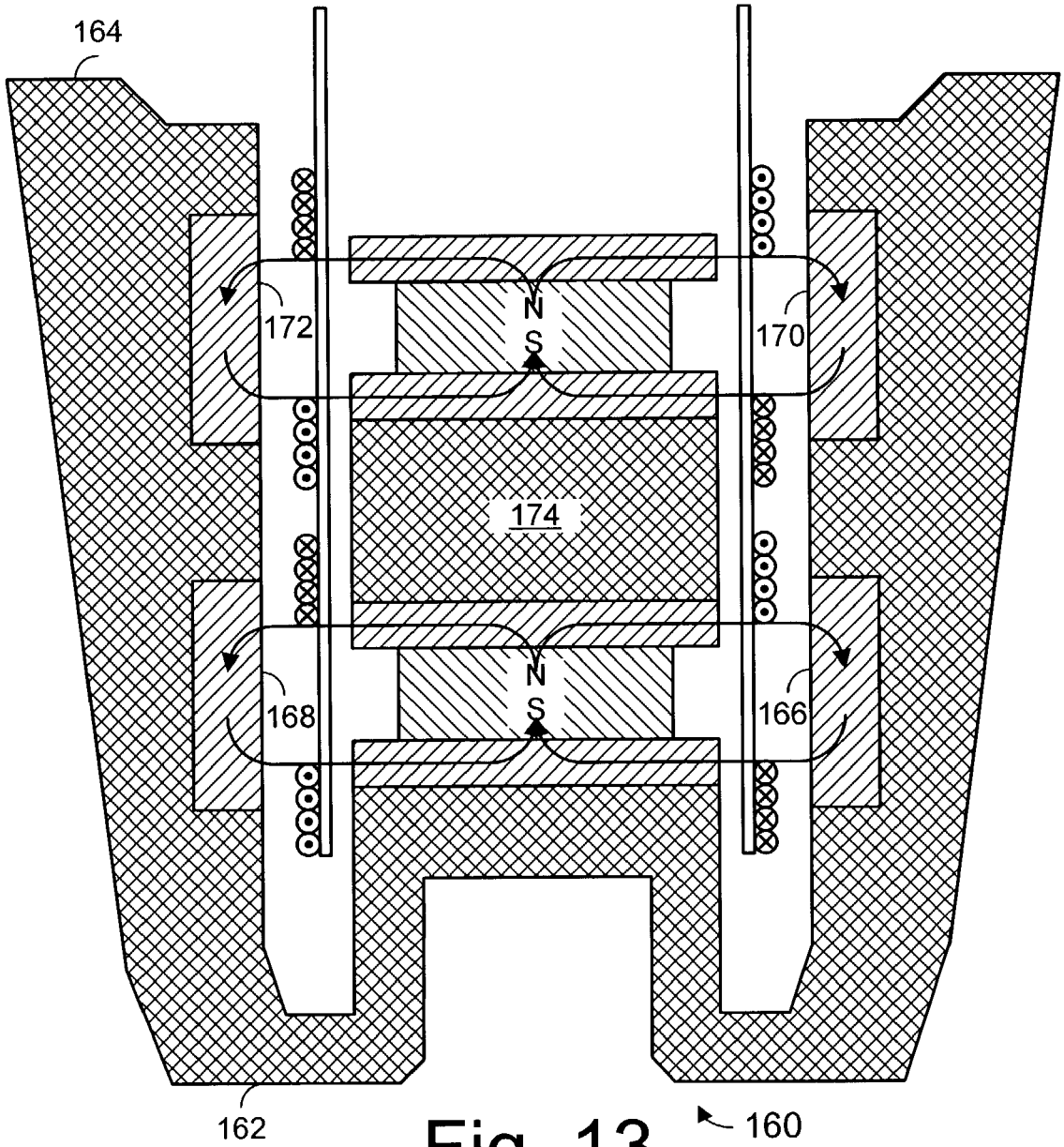
FIG. 13 shows, in cross-section, a dual magnetic circuit motor embodiment in which the external magnetic yokes are segmented pieces held in place within a monolithic cooling structure.

FIG. 13 illustrates another embodiment of a motor structure 160 which employs two instances of a semi-overhung voice-coils-outside-plates structure and an internal magnet configuration. The motor structure includes a non magnetically conductive cup 162 which can also serve as a massive heatsink to cool the motor structure. The cup may include an extension 164 (shown truncated) which extends upward to form the basket of the speaker. The motor structure includes an internal stack of magnets, plates, and non magnetically conductive spacers.

In the case where the cup is a monolithic structure, in order to insert the external magnetically conductive rings, the rings may each comprise multiple segmented components which may be inserted prior to the insertion of the central magnet/plate stack. For example, the lower ring can include two or more segments 166, 168, and the upper ring can include two or more segments 170, 172. In some cases, it may be necessary to lower the height of the axial floor of the cup and install a spacer (not shown) between it and the lowermost plate, in order to have clearance to install the lower ring segments.

The distance between the magnetic circuits is adjusted by the thickness of the spacer 174 between the drive plates, with corresponding adjustments to the distance between the innermost voice coils and the distance between the external rings or yokes.

Note that it is not necessary that the power of the two push-pull circuits be equal, as they operate independently and cumulatively. Thus, they may employ different strength magnets, different thickness plates, different height voice coils, and so forth. Furthermore, one could have a voice-coils-inside-plates topology while the other has a voice-coils-outside-plates topology.

Figure 14:
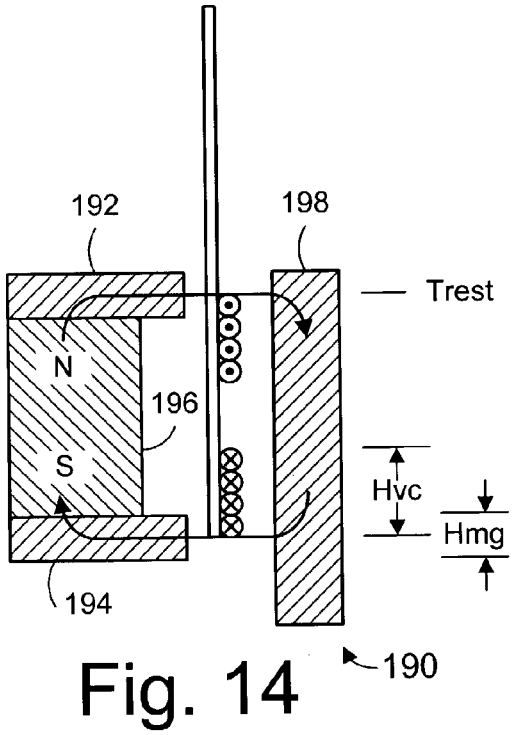
FIGS. 14–16 show, in cross-section, yet another embodiment, in which the semi-overhung voice coils are disposed at inner boundaries of the magnetic air gaps rather than at outer boundaries.

FIG. 14 illustrates a different embodiment of the motor structure 190 using a different spacing configuration of the semi-overhung voice coils, and has been simplified to represent either an internal or external magnet motor geometry. The motor structure includes a top plate 192 and a bottom plate 194 magnetically coupled to opposite sides of a permanent magnet 196. A yoke 198 (which may be either a pole piece or a cup) defines the upper and lower magnetic air gaps and provides a path for the magnetic flux from one magnetic air gap to the other. At the centered position, which may in some cases be the at-rest position, the upper voice coil occupies the lower half of the upper magnetic air gap, and the lower voice coil occupies the upper half of the lower magnetic air gap. At this position, the top of the upper voice coil is at a position Trest.

Each voice coil may have a height Hvc. It should be noted that, strictly speaking, it is not necessary that the two voice coils be of equal height in this or the other embodiments. In some applications, it may be desirable to allow greater one-way linear travel in one direction from Trest than in the other; this is accomplished by making the leading (in the direction of desired greater linear travel) voice coil longer than the trailing voice coil (or, in the coils-outside-plates embodiment of FIG. 5, by making the trailing voice coil longer than the leading voice coil).

Figure 15:
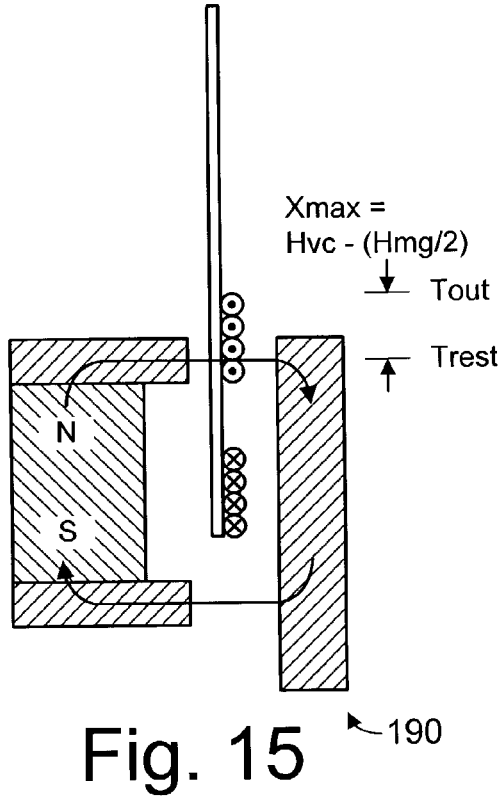

FIG. 15 illustrates the voice coil assembly at maximum linear extension, at which the trailing lower end of the upper voice coil has reached the bottom edge of the upper magnetic air gap, and the top of the upper voice coil is at position Tout. Xmax in this direction is the distance from Trest to Tout, or the height Hvc of the upper voice coil minus half the height Hmg of the upper magnetic air gap.

Figure 16:
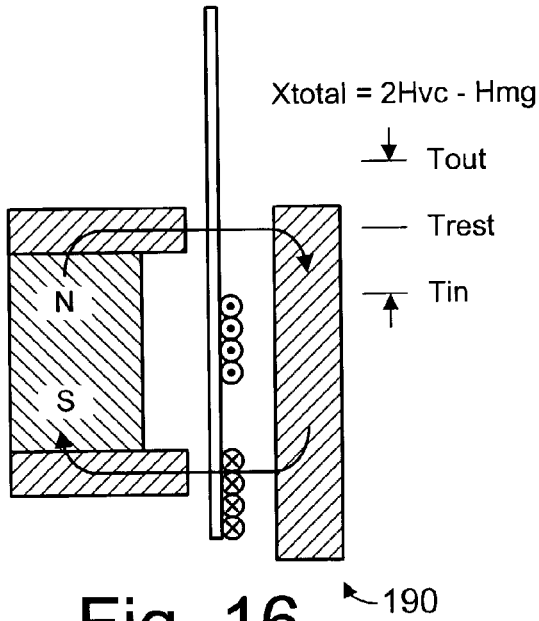

FIG. 16 illustrates the voice coil assembly at maximum linear retraction, at which the trailing upper end of the lower voice coil has reached the top edge of the lower magnetic air gap, and the top of the upper voice coil is at position Tin. Xmax in this direction is the distance from Trest to Tin. Note that if the voice coils are of unequal height, Xmax in one direction from Trest will be different than Xmax in the other direction. In the case where the voice coils are of equal height, the total linear travel Xtotal is equal to twice the height of a voice coil minus the height of a magnetic air gap.

If the magnetic air gaps are of unequal height, the geometry becomes somewhat less optimized, and it is not necessarily the case that throughout the entire travel from Tout to Tin the same number of voice coil windings (or, in other words, the same amount of magnetic air gap height) will be active. In some applications, this may be desirable, but in most cases it will not.

Figure 17:
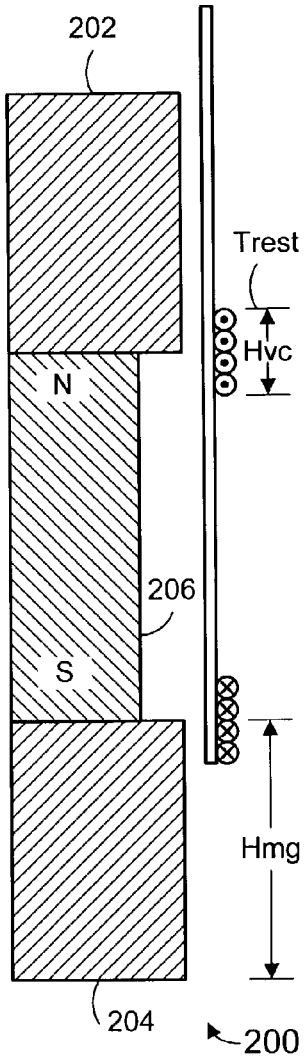
FIGS. 17–19 show, in cross-section, an embodiment of the invention using semi-underhung voice coils and a voice-coils-inside-plates topology.

FIG. 17 illustrates an embodiment of part of a motor structure 200 according to this invention, illustrating in closer detail the use of a semi-underhung voice coil configuration. The motor structure includes a top plate 202 and a bottom plate 204 magnetically coupled to opposite sides of a magnet 206. For ease of illustration, the yoke and other structures are not shown.

At the centered position, an upper semi-underhung voice coil is centered across one edge of an upper magnetic air gap, and a lower semi-underhung voice coil is centered across an opposite edge of a lower magnetic air gap. As illustrated, the motor structure may use a voice-coils-inside-plates configuration, but, as demonstrated above, it could alternatively use a voice-coils-outside-plates configuration. In the semi-overhung geometries previously illustrated, the seamless linear handoff is achieved by, at the centered position, having opposite halves of magnetic air gaps utilized or active, and as the voice coil assembly moves in a particular direction, using more and more of one magnetic air gap and less and less of the other until the one magnetic air gap is 100% active and the other is inactive. By way of contrast, in the semi-underhung configuration, the seamless linear handoff is achieved by, at the centered position, having opposite halves of voice coils utilized or active, and as the voice coil assembly moves in a particular direction, using more and more of one voice coil and less and less of the other until the one voice coil is 100% active and the other is inactive.

Figure 18:
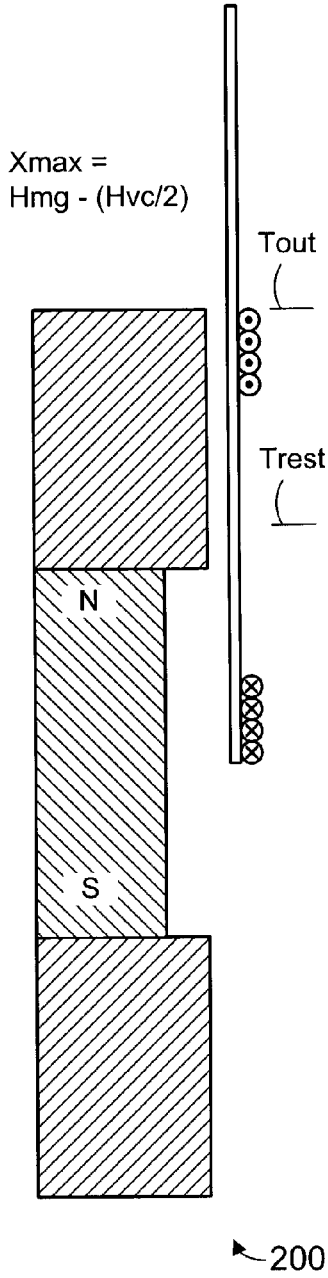

FIG. 18 illustrates the motor structure 200 with the voice coil assembly at a maximum extension position of the linear travel region. The top of the upper voice coil is at a position Tout. Xmax is the height of a drive plate minus half the height of a voice coil.

Figure 19:
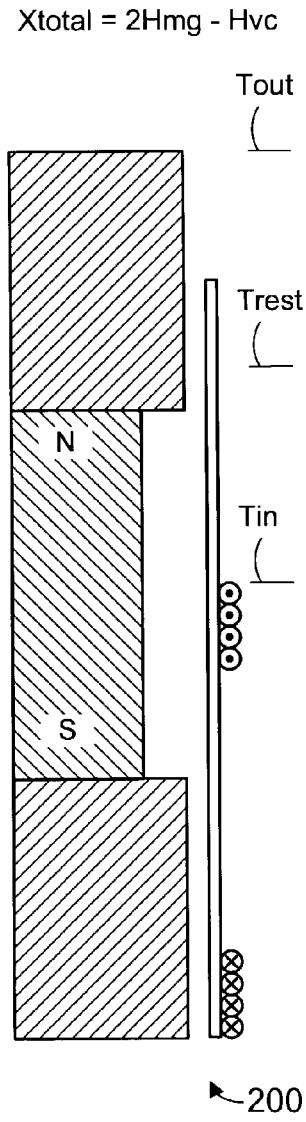

FIG. 19 illustrates the motor structure 200 with the voice coil assembly at a maximum linear retraction position. The top of the upper voice coil is at a position Tin. The total linear travel from Tout to Tin is the height of the two drive plates minus the height of a voice coil.

Figure 20:
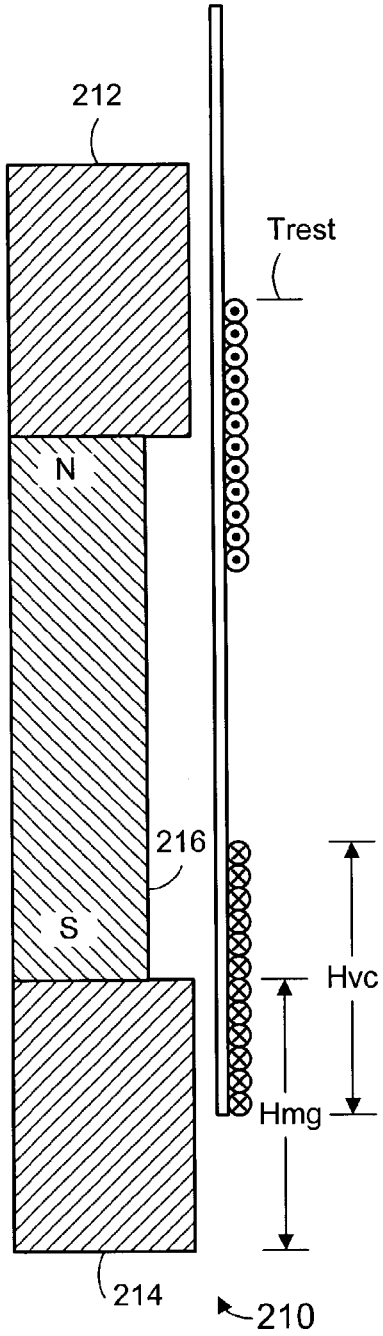
FIGS. 20–22 show, in cross-section, an embodiment of the invention using equalhung voice coils and a voice-coils-inside-plates topology.

FIG. 20 illustrates an embodiment of the invention using semi-equalhung voice coils, in which the height Hvc of a voice coil is substantially the same as the height Hmg of its magnetic air gap. The motor structure 210 includes a top plate 212 and a bottom plate 214 magnetically coupled to opposite sides of a magnet 216. The embodiment shown uses a voice-coils-inside-plates configuration. At the centered position, the upper voice coil is centered about the bottom edge of the top plate, and the lower voice coil is centered about the top edge of the bottom plate. The top of the upper voice coil is at a position Trest which is also the center of the top magnetic air gap. Note that, in this configuration, the magnet (or magnet plus spacers) cannot be shorter than a voice coil, or the voice coils would overlap and ideally should be close to twice Hvc.

Figure 21:
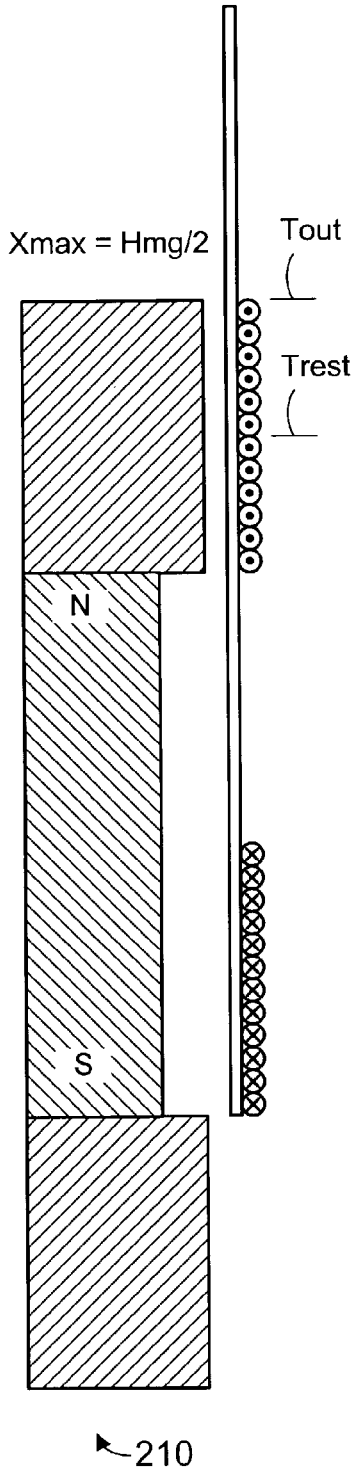

FIG. 21 shows that, at maximum linear extension, the bottom edge of the lower voice coil has just exited its magnetic air gap, and the bottom edge of the upper voice coil has just entered its magnetic air gap. The top of the upper voice coil is at position Tout, which coincides with the top of the upper magnetic air gap. Xmax is equal to the distance from Trest to Tout or, in other words, half the height of one of the magnetic air gaps or half the height of one of the voice coils.

Figure 22:
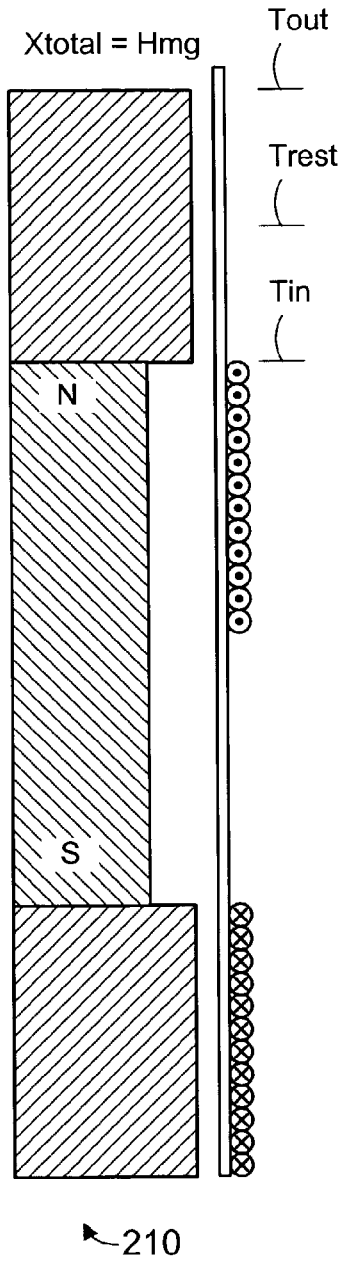

FIG. 22 shows that, at maximum linear retraction, the top edge of the upper voice coil has just exited its magnetic air gap, and the top edge of the lower voice coil has just entered its magnetic air gap. The top of the upper voice coil is at position Tin, which coincides with the bottom of the upper magnetic air gap. The total linear travel is thus equal to the height of one of the voice coils or one of the magnetic air gaps.

In configurations in which there are two push-pull magnetic circuits, it is not necessarily the case that they are equally configured. For example, one could have its voice coils inside its plates, while the other has its voice coils outside its plates, and/or one could be semi-underhung while the other is semi-overhung.

Figure 23:
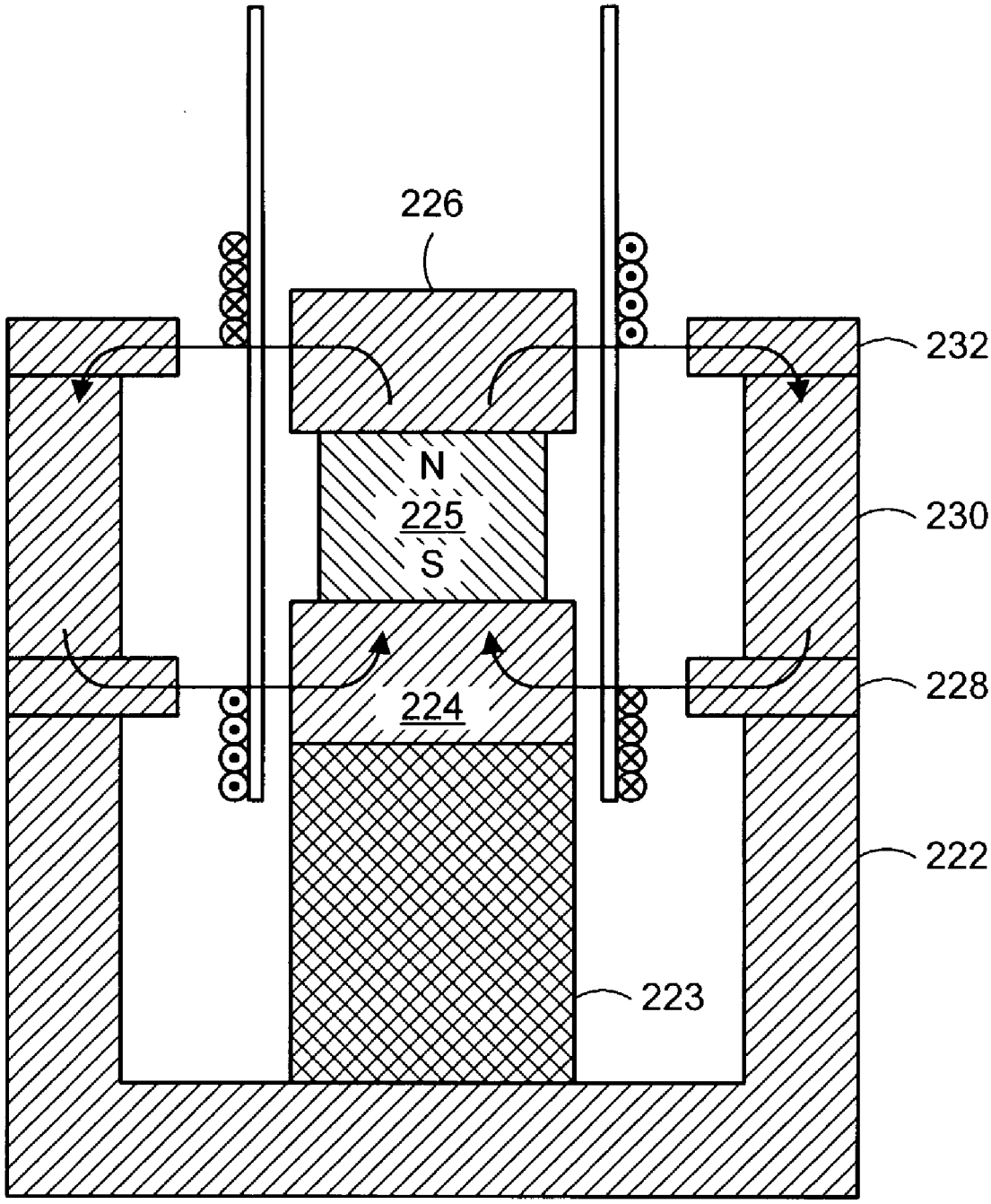
FIG. 23 shows, in cross-section, an internal magnet semi-overhung voice-coils-outside-plates embodiment of the invention.

FIG. 23 shows a slightly different configuration in which the magnet is not coupled between the two conventional plates, but the motor structure 220 nevertheless uses a push-pull geometry. The motor structure includes a cup 222 which includes an internal spacer 223 which supports a lower pole piece 224, an internal magnet 225, and an upper pole piece 226. A lower ring-shaped plate 228 is coupled to the cup. A magnetically conductive spacer (or an external reverse polarity magnet) 230 is coupled between the lower plate and an upper ring-shaped plate 232. The lower plate defines a magnetic air gap between itself and the lower pole piece, and the upper plate defines a magnetic air gap between itself and the upper pole piece. The voice coils and plates exhibit any of the foregoing geometries according to the principles of this invention. A magnetic circuit exists from the internal magnet, through the upper pole piece, over the upper magnetic air gap, through the top plate, external magnet or spacer, and lower plate, over the lower magnetic air gap, through the lower pole piece, and back to the internal magnet. The cup could be non magnetically conductive.

Figure 24:
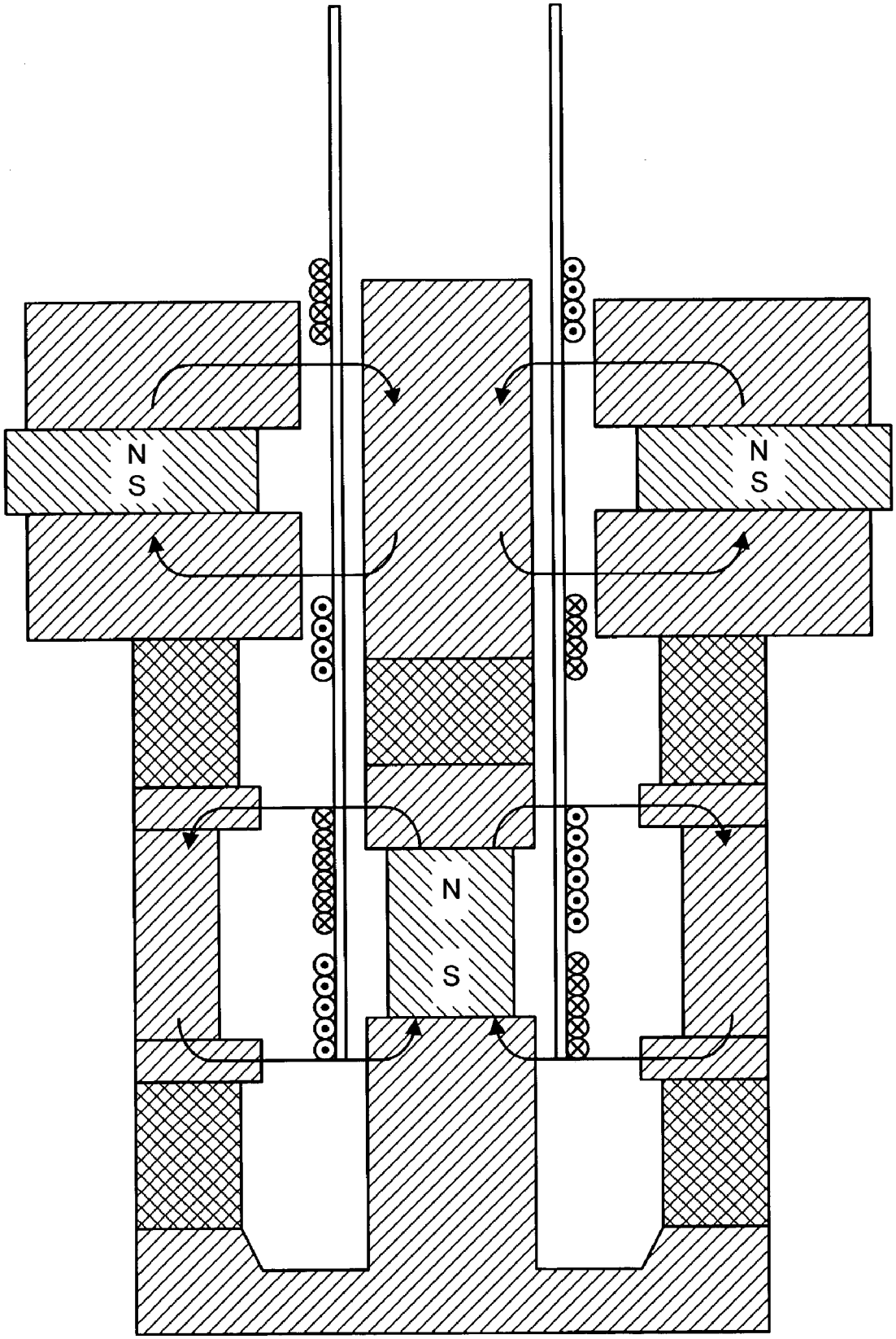
FIG. 24 shows, in cross-section, a hybridized motor structure using many of the principles of this invention in combination.

FIG. 24 illustrates a hybridized a motor structure 240 utilizing several embodiments of inventive concepts of this invention. The motor structure includes two push-pull magnetic circuits, one with an internal magnet motor geometry, and the other with an external magnet motor geometry. One uses a voice-coils-outside-plates topology, and the other uses a voice-coils-inside-plates topology. One uses semi-overhung voice coils, and the other uses semi-underhung voice coils. One is stronger than the other. One has different size voice coils than the other. The voice coils in one are of equal size as each other, and the voice coils in the other are of different sizes from each other.

Figure 25:
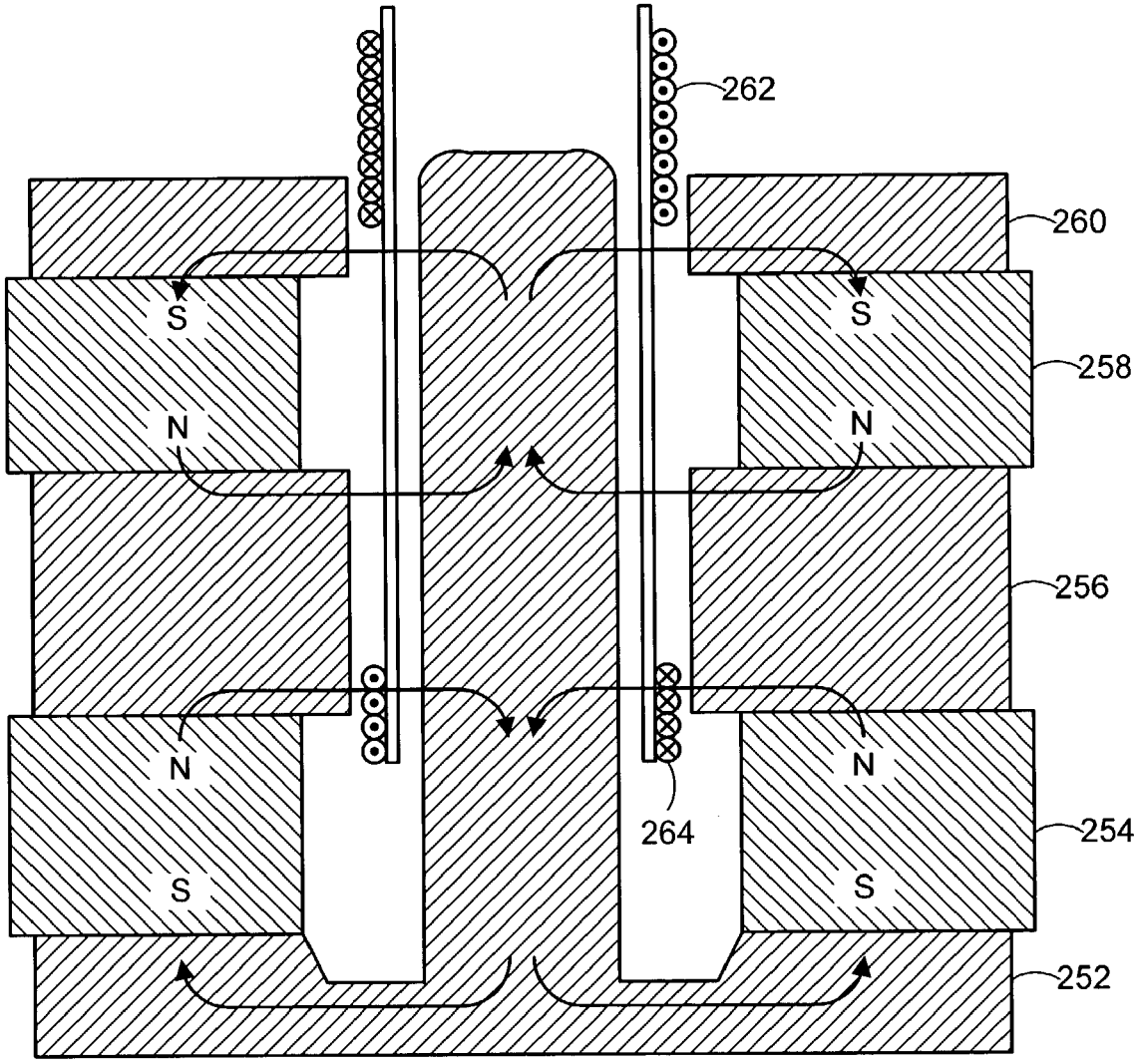
FIG. 25 shows, in cross-section, a semi-over-underhung motor structure according to this invention.

FIG. 25 illustrates another embodiment of the invention. The motor structure 250 includes a pole plate 252 to which is magnetically coupled a lower external ring magnet 254. A thick lower plate 256 is magnetically coupled to the lower magnet. An upper external ring magnet 258 is magnetically coupled between the lower plate and a thin upper plate 260. The upper magnet, upper and lower plate, and pole piece comprise the main portion of the push-pull magnetic circuit. The lower magnet is added to increase the magnetic flux flowing into the lower plate. It is desirable to achieve the same level of magnetic flux density in the upper and lower magnetic air gaps. Because the lower plate is much thicker than the upper plate, if only the upper magnet were used, the magnetic flux density over the upper magnetic air gap would be higher than that over the lower magnetic air gap, as the same quantity of magnetic flux would be condensed into the thinner dimension of the upper magnetic air gap. The lower magnet compensates for this, and equalizes the magnetic flux density between both magnetic air gaps.

The voice coil assembly includes both a semi-underhung voice coil and a semi-overhung voice coil. The taller semi-overhung voice coil operates in the smaller upper magnetic air gap, while the shorter semi-underhung voice coil operates in the larger lower magnetic air gap. The height of the upper magnetic air gap is substantially equal to the height of the lower voice coil, and the height of the lower magnetic air gap is substantially equal to the height of the upper voice coil. This, together with the substantially equal magnetic flux densities of the two magnetic air gaps, means that as the voice coil assembly moves in and out of the motor structure, substantially the same total BL will be achieved throughout the linear travel range.

The geometry could, alternatively, use a semi-underhung upper voice coil and a semi-overhung lower voice coil. It could, alternatively, use a voice-coils-inside-plates configuration, in either case.

Figure 26:
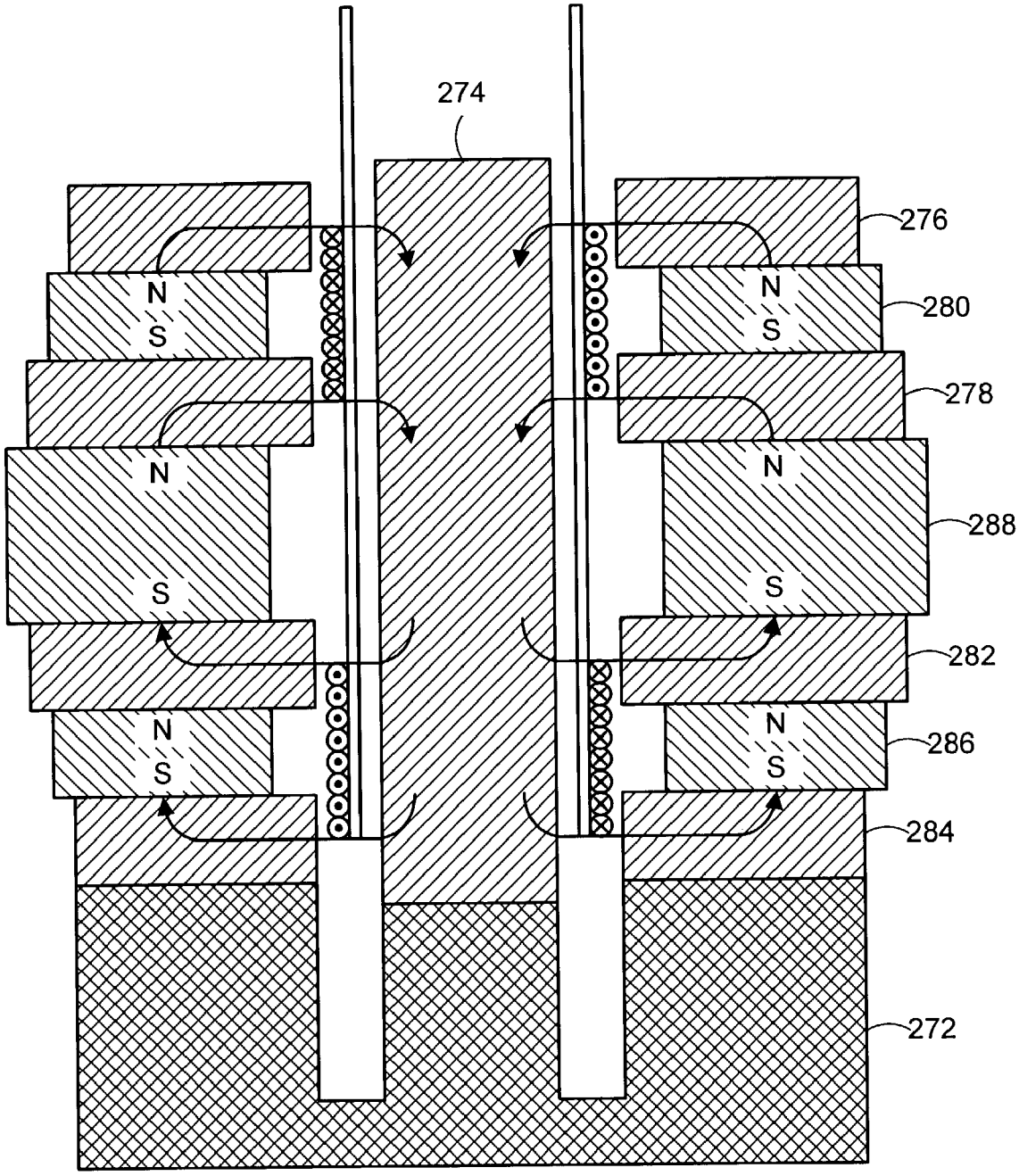
FIG. 26 shows, in cross-section, a quad gap implementation of the push-pull motor of this invention.

FIG. 26 illustrates an embodiment of a push-pull transducer motor 270 which combines this invention with the push-push multiple magnetic air gap invention of the co-pending application entitled "Push-Push Multiple Magnetic Air Gap Transducer". The motor includes, fundamentally, a single push-pull magnetic circuit. The push half includes two drive magnetic air gaps, and the pull half includes two drive magnetic air gaps. The motor includes a non-magnetically conductive back plate 272 which supports a magnetically conductive pole piece 274. The upper half of the magnetic circuit includes a first drive plate 276 and a second drive plate 278 magnetically coupled to opposite sides of a first magnet 280. The lower half of the magnetic circuit includes a third drive plate 282 and a fourth drive plate 284 magnetically coupled to opposite sides of a second magnet 286. These upper and lower halves of the circuit are magnetically coupled to opposite sides of a third magnet 288. The first through fourth drive plates define first through fourth magnetic air gaps, respectively, between themselves and the pole piece.

This central magnet 288 will typically be more powerful than the other two magnets. It provides all of the magnetic flux which flows over the magnetic air gaps. The first and second magnets are for balancing and stabilizing the magnetic flux over their respective magnetic air gap pairs and are optional but advantageous. In fact, the first and second magnets could be replaced by magnetically conductive spacers. Strictly speaking, it is not necessary for the magnetic flux over all four magnetic air gaps to be equal. What is important is that the magnetic flux over the first and fourth (outer) magnetic air gaps to be substantially equal, and that the magnetic flux over the second and third (inner) magnetic air gaps to be substantially equal, even if the first and fourth differ from the second and third. Similarly, it is not strictly necessary that all four plates be of equal thickness. The first and fourth plates should be of substantially equal thickness, and the second and third plates should be of substantially equal thickness.

The three magnets may advantageously have their polarity in the same orientation. This permits them to be charged after assembly of the motor structure.

The motor structure further includes an upper voice coil which extends substantially from the middle of the first magnetic air gap to the middle of the second magnetic air gap, and a lower voice coil which extends substantially from the middle of the third magnetic air gap to the middle of the fourth magnetic air gap.

As the voice coil assembly moves in a particular direction away from this centered position, one of the voice coils will move out of its inner magnetic air gap (second or third) and into its outer magnetic air gap (first or fourth), but the other voice coil will simultaneously move out of its outer magnetic air gap and into its inner magnetic air gap. Although the motive force exerted upon either given one of the voice coils may change as this happens, the motive force exerted upon the other voice coil will change in the opposite manner, and the total motive force on the voice coil assembly will remain constant throughout the linear travel region.

This multiple magnetic air gap principle can readily be extended to three or more gaps, according to the teachings of the co-pending application. The motor may be configured differently, according to the teachings of the present application. For example, the single voice coil the upper push-push portion of the circuit is merely a degenerate case of the voice coils taught in this application, and could be replaced with a pair of voice coils, either inside or outside the plates. The push portion of the circuit should be substantially a mirror image of the pull portion of the circuit; for example, it would not work well to use voice coils inside the push gaps and voice coils outside the pull gaps, because voice coil assembly movement would then not result in a net zero change in the total motive force. The salient feature of this embodiment is the substantially net zero change over the linear region.

Figure 27:
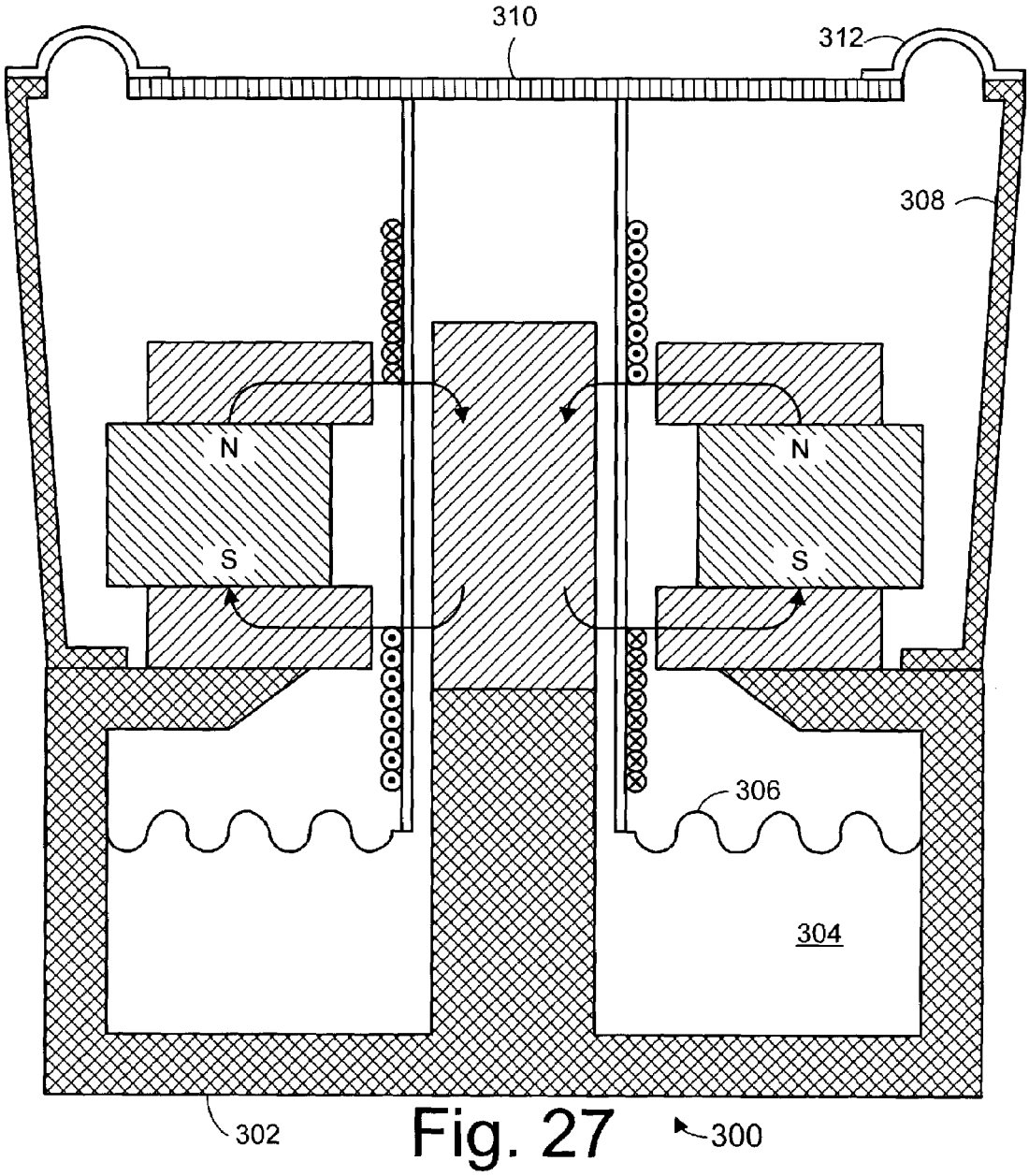
FIG. 27 shows, in cross-section, an audio speaker utilizing the push-pull motor of this invention in conjunction with a diaphragm assembly which is suspended at points beyond both ends of the motor.

FIG. 27 illustrates an audio speaker 300 which makes particular advantage of what otherwise may seem a disadvantageous characteristic of some embodiments of this invention, that being that the voice coil assembly can in some embodiments be rather long. The speaker includes a body 302 which serves as the motor support structure. The body includes a large-diameter space 304 into which the lower end of the bobbin extends. This end of the bobbin extends some distance out of the motor structure. A spider 306 or other suspension component is coupled to the lower end of the bobbin and to the inside of the body. A frame 308 is coupled to the body and provides support for a diaphragm assembly. The diaphragm 310 is coupled to the bobbin. A surround 312 or other suspension component couples the diaphragm to the frame. In one embodiment, the diaphragm is a rigid planar diaphragm, as shown.

The two suspension components have a large axial distance between them. This greatly increases their ability to stabilize the voice coil assembly and prevent rocking and other undesirable motions of the voice coil assembly and the diaphragm.

Figure 28:
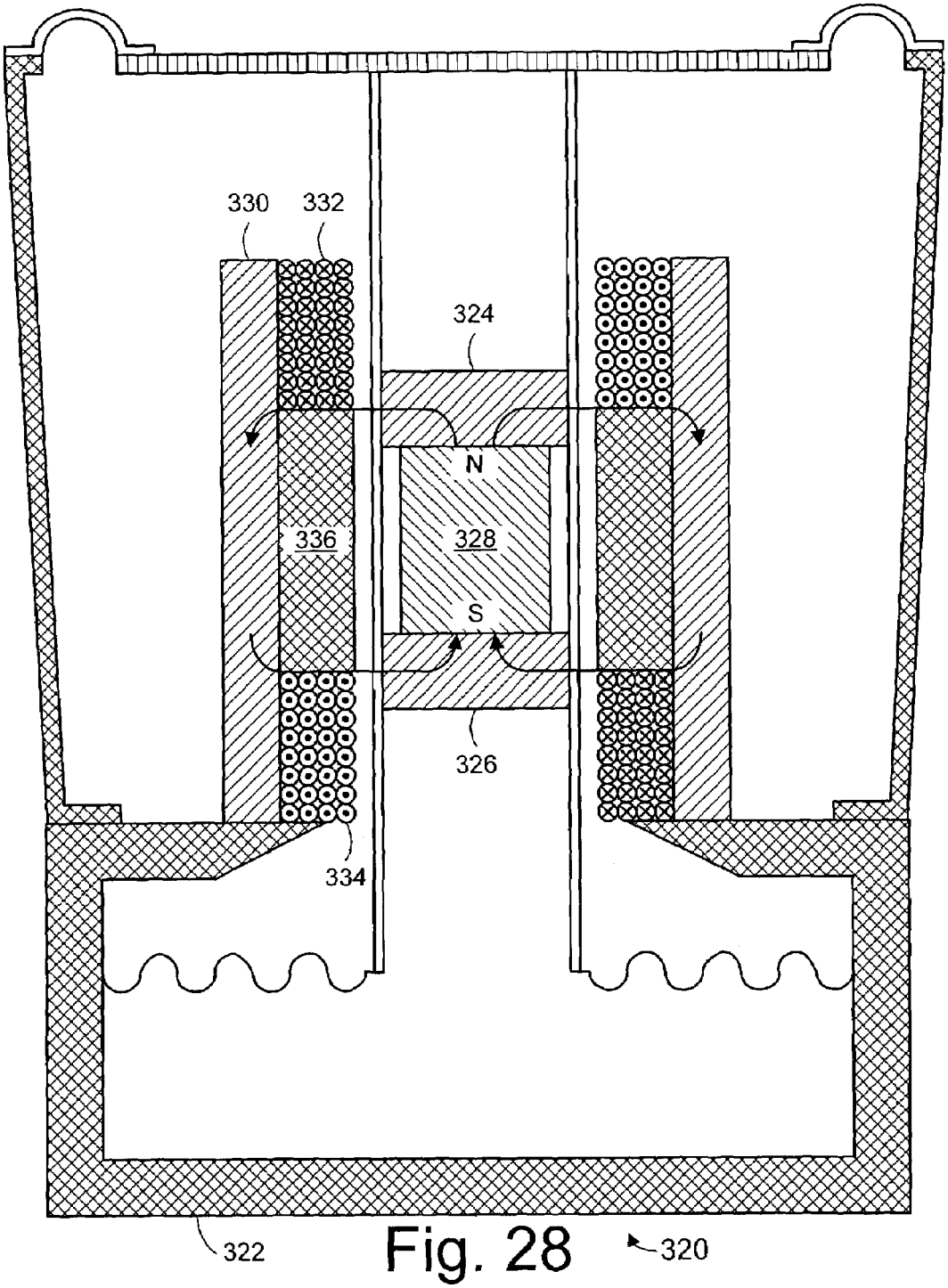
FIG. 28 shows, in cross-section, an audio speaker utilizing the push-pull motor in a moving magnet configuration.

FIG. 28 illustrates an electromagnetic transducer 320 which utilizes the semi-hung push-pull geometry of this invention in a moving magnet configuration motor. For simplicity, the transducer is shown in the form of a speaker. However, moving magnet embodiments of this invention may have particular applicability in, for example, actuators such as the silent ring vibrators used in cellular telephones and pagers. Other useful applications may include, for example, mechanical feedback joysticks and video game controllers, as well as larger-scale applications such as vibration cancellation systems for automobiles, airplanes, motors, machinery, and so forth.

The transducer may include a body 322 for supporting the motor structure. The motor structure includes an upper plate 324 and a lower plate 326 coupled to opposite sides of a magnet 328, as well as a cylindrical yoke 330 within which are disposed an upper stationary voice coil 332 and a lower stationary voice coil 334 which may, optionally, be separated by a non-magnetically conductive spacer 336.

In applications in which the moving magnet motor structure is used to drive an acoustic transducer such as an audio speaker or a microphone, the moving magnet and its upper and lower plates may be coupled to a bobbin which is coupled to a diaphragm. In some embodiments, such as that illustrated, the bobbin may extend out the lower end of the motor structure, where it is supported by a spider.

In other applications in which the moving magnet motor structure is used to drive a linear actuator such as a vibrator, the diaphragm may not be necessary. In some applications, the moving magnet and plate assembly may not necessarily be coupled to the bobbin, or the bobbin itself may be omitted. For example, the magnet and plate assembly could be loosely fit within a non-moving tube (not shown), which could be lightly lubricated. In some applications, the moving magnet and plate assembly could be directly suspended, such as by a pair of coil springs mounted axially. In other applications, no suspension is used at all.

In some embodiments, the moving magnet and plate assembly could be employed to provide mechanical power to some external component such as a lever. In other embodiments, the moving magnet and plate assembly could serve as a pneumatic or hydraulic pump to force fluid in and out of the motor structure, typically within the confines of a tube.

The moving magnet and plate assembly may optionally be augmented with the addition of an electrically conductive ring encompassing the outer diameter of the magnet, to sink eddy current and help cool the motor structure. The spacer 336 can also be electrically conductive for these purposes.

In another embodiment, the motor structure may use an external moving magnet assembly. The external moving magnet assembly may have a suspension, such as a coil spring, or such as a spider.

CONCLUSION

Figure 1:
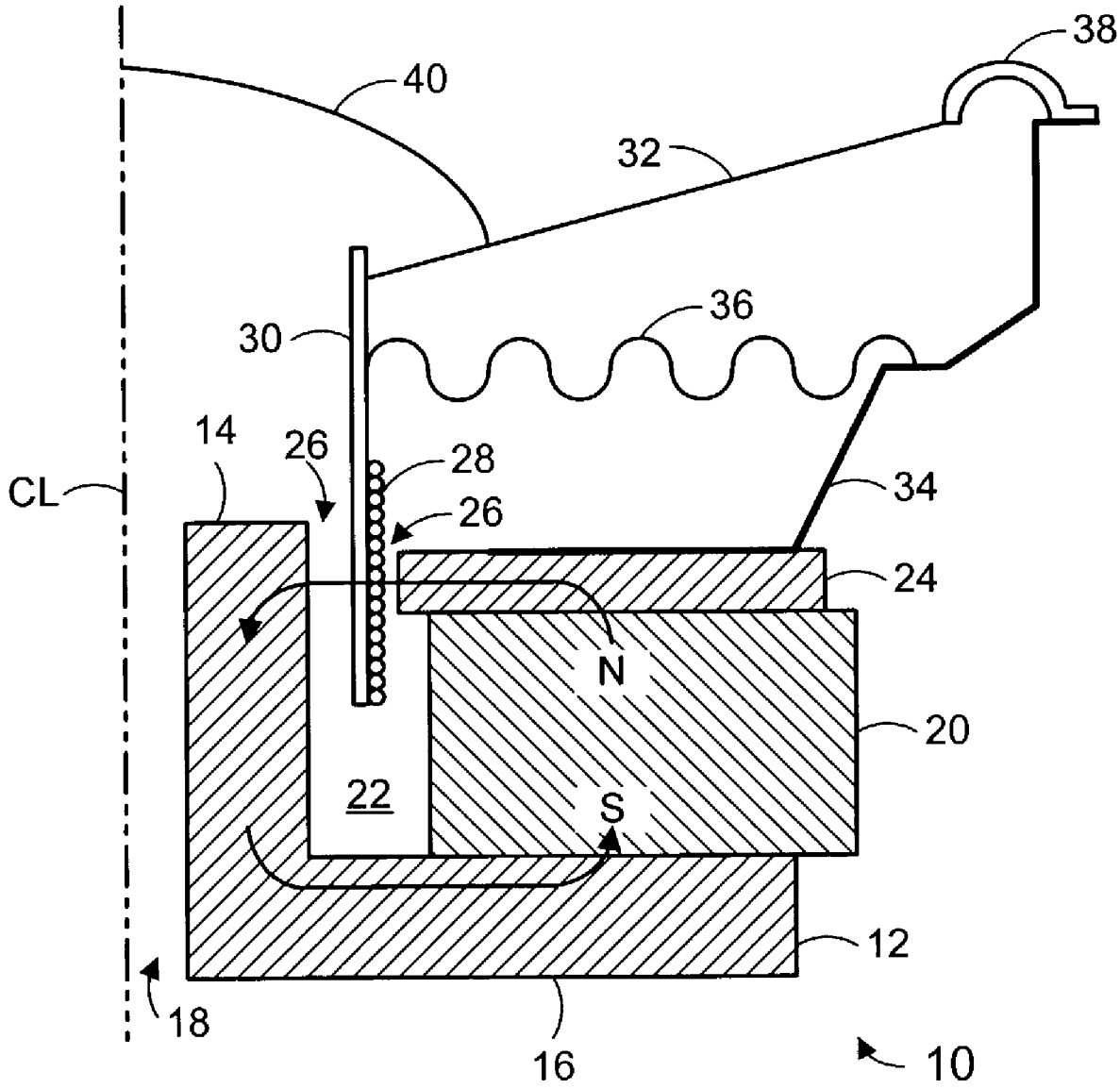
FIG. 1 shows, in cross-section, a conventional speaker geometry according to the prior art.
Figure 2:
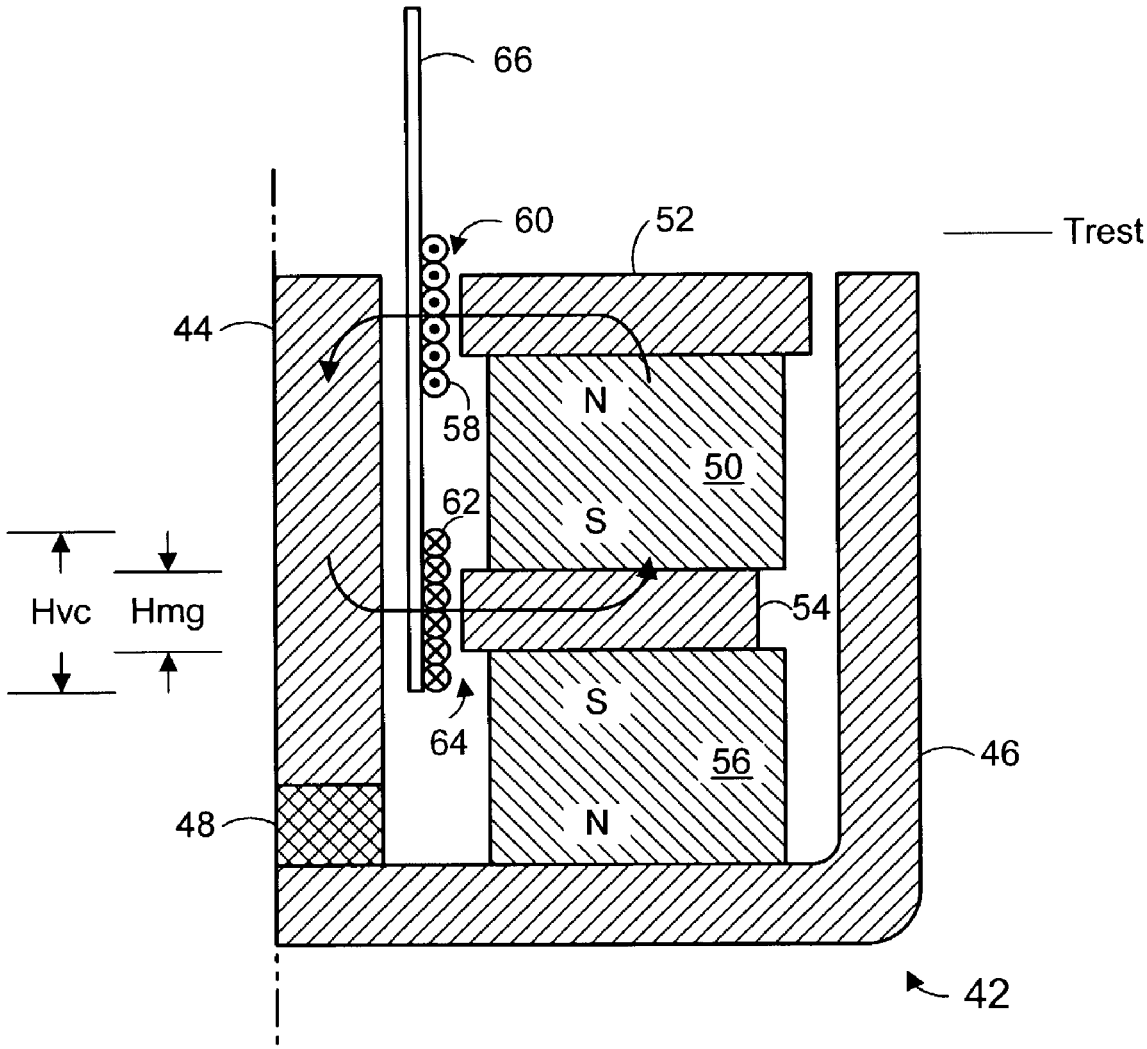
FIGS. 2–4 show, in cross-section, the prior art push-pull speaker as taught by Kobayashi, specifically showing the middle resting point, maximum extension, and maximum retraction of the voice coil, respectively, and using overhung voice coils.
Figure 3:
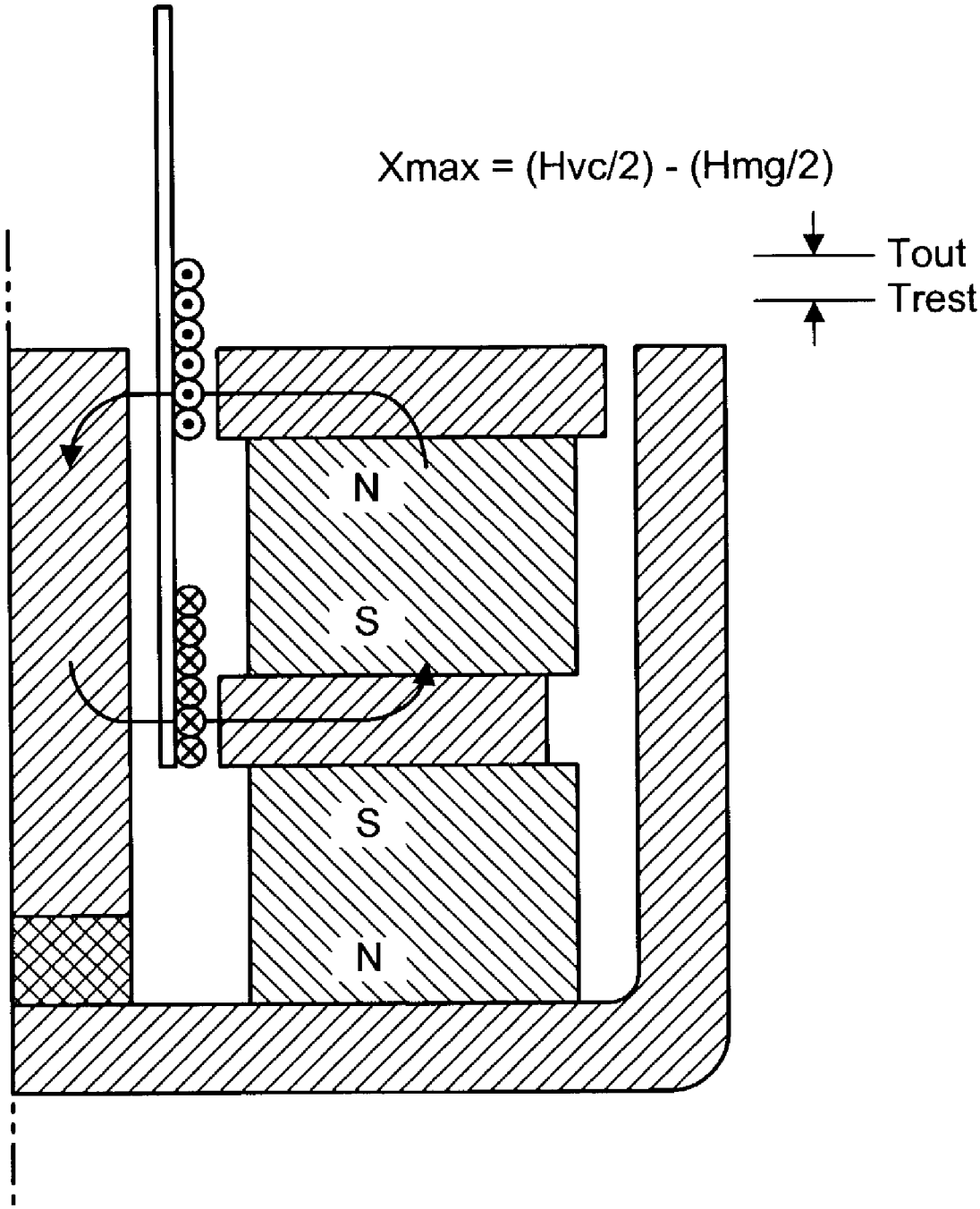
Figure 4:
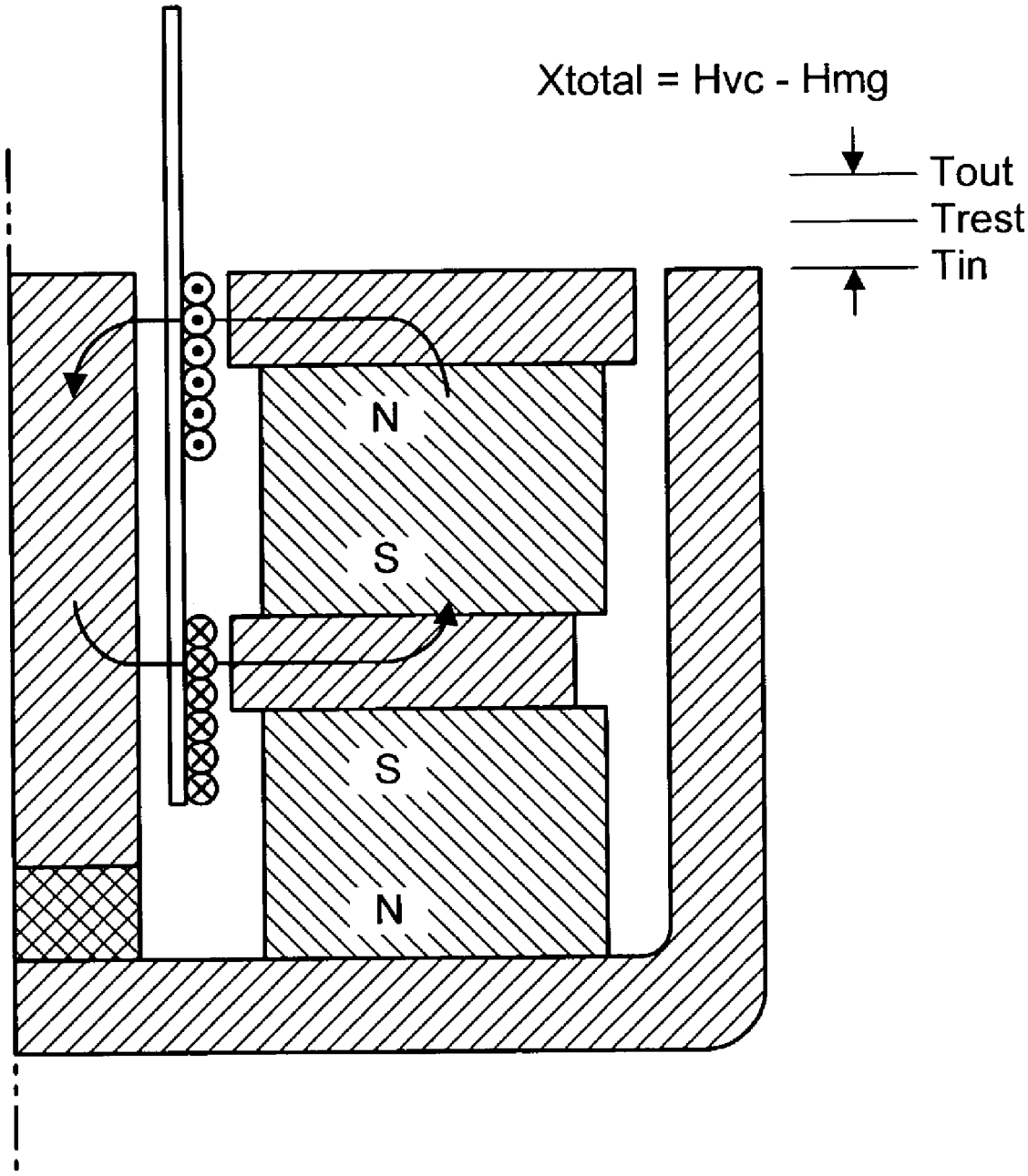

Prior art overhung push-pull motors, such as that shown in FIG. 2, utilize 100% of both of their magnetic air gaps over the entire linear travel distance. Xmax is limited to half the height of one voice coil minus half the height of one magnetic air gap. Prior art underhung push-pull motors utilize 100% of both of the voice coils over their entire linear travel distance. Xmax is limited to half the height of one magnetic air gap minus half the height of one voice coil.

The present invention utilizes BOTH less than 100% of the total magnetic air gap AND less than 100% of the total voice coil windings during linear operation, but, in exchange for this tradeoff, achieves significantly increased linear travel.

Most of the examples shown above generally utilize a centered position geometry with 50% of each voice coil (or magnetic air gap) active. This configuration will achieve the largest amount of substantially constant BL travel. In other words, it will generate a BL curve with the largest flat top region.

In other embodiments of the invention, the relative positions of the voice coils and plates may be adjusted such that something other than 50% of each magnetic air gap is active at the centered position. For example, the total distance over which there are active voice coil windings disposed within at least one magnetic air gap can be made quite large, by starting with less than 50% active. This may result in e.g. a "two camel hump" BL curve over the length of the total powered travel. This may be advantageous is some applications. For example, if the suspension components are relatively soft near their at-rest position but somewhat stiffer at under-tension positions, the two camel hump configuration may be used to compensate; at the center, where the suspension is most compliant, the motor is less powerful, and away from center where the suspension is less compliant, the motor is more powerful.

In still other embodiments, more than 50% could be used, to increase the BL, albeit with a sacrifice in the size of the maximally flat region of Xmax.

Some classes of transducers may have between 90% and 10% of their windings (or magnetic air gaps) active at the centered position. Other classes of transducers may have between 75% and 25% of their windings (or magnetic air gaps) active at the centered position. Still other classes of transducers may have between 66% and 33% of their windings (or magnetic air gaps) active at the centered position. And yet other classes of transducers may have between 55% and 45% of their windings (or magnetic air gaps) active at the centered position. All of these will exhibit some degree of a less than flat BL curve.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the claims, the phrase "magnetically coupled to" is intended to mean "in magnetic communication with" or in other words "in a magnetic flux circuit with", and not "mechanically affixed to by means of magnetic attraction." In the claims, the phrase "air gap" is intended to mean "gap over which magnetic flux is concentrated" and not limited to the case where such gap is actually filled with air; the gap could, in some applications, be filled with any suitable gas or liquid such as magnetic fluid, or even be under vacuum.

When one component is said to be "adjacent" another component, it should not be interpreted to mean that there is absolutely nothing between the two components, only that they are in the order indicated.

The several features illustrated in the various figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer comprising:

(a) a push-pull magnetic circuit including, a top plate defining an upper magnetic air gap, a bottom plate defining a lower magnetic air gap, a total available magnetic air gap height comprising the upper and lower magnetic air gaps, and a magnet providing magnetic flux over the upper magnetic air gap in a first direction and magnetic flux over the lower magnetic air gap in a second direction opposite the first direction; and (b) a voice coil assembly including, a bobbin, an upper voice call having windings coupled to the bobbin, a lower voice coil having windings coupled to the bobbin, and a total available voice coil height comprising the upper and lower voice coils;

(c) wherein the upper and lower voice coils are coupled to the bobbin at respective positions such that BOTH, less than 100% of the total available magnetic air gap height contains voice coil windings, AND less than 100% of the total available voice coil height is within the magnetic air gaps;

(d) and wherein at least one of the voice coils is one of semi-overhung and semi-underhung.

2. The electromagnetic transducer of claim 1 having a voice-coils-axially-inside-plates configuration.

3. The electromagnetic transducer of claim 1 wherein:

one of the voice coils is semi-underhung, and the other of the voice coils is semi-overhung.

4. The electromagnetic transducer of claim 1 wherein:

the magnet comprises an external magnet.

5. The electromagnetic transducer of claim 1 wherein:

the magnet comprises an internal magnet.

6. The electromagnetic transducer of claim 1 wherein:
the voice coils are of substantially different height.

7. The electromagnetic transducer of claim 1 wherein:
the magnetic air gaps are of substantially different height.

8. The electromagnetic transducer of claim 1 further comprising:
a bucking magnet providing magnetic flux to one of the plates; and
a return pat plate defining a non-driving magnetic air gap for a low reluctance return path for magnetic flux to the bucking magnet.

9. The electromagnetic transducer of claim 1 further comprising:
a diaphragm assembly coupled to the bobbin.

10. The electromagnetic transducer of claim 1 configured as an audio speaker.

11. The electromagnetic transducer of claim 1 configured as a microphone.

12. The electromagnetic transducer of claim 1 configured as an actuator.

13. The electromagnetic transducer of claim 1 configured as a position sensor.

14. An electromagnetic transducer comprising:
(a) a push-pull magnetic circuit including,
a top plate defining an upper magnetic air gap,
a bottom plate defining a lower magnetic air gap,
a total available magnetic air gap height comprising the upper and lower magnetic air gaps, and
a magnet providing magnetic flux over the upper magnetic air gap in a first direction and magnetic flux over the lower magnetic air gap in a second direction opposite the first direction; and
(b) a voice coil assembly including,
a bobbin,
an upper voice coil having windings coupled to the bobbin,
a lower voice coil having windings coupled to the bobbin, and
a total available voice coil height comprising the upper and lower voice coils:
(c) wherein the upper and lower voice coils are coupled to the bobbin at respective positions such that BOTH,
less than 100% of the total available magnetic air gap height contains voice coil windings, AND
less than 100% of the total available voice coil height is within the magnetic air gaps;
a second such push-pull magnetic circuit; and
two additional voice coils arranged in the second magnetic circuit as the first and second voice coils are arranged in their magnetic circuit.

15. An electromagnetic transducer comprising:
(a) a push-pull magnetic circuit including,
a top plate defining an upper magnetic air gap,
a bottom plate defining a lower magnetic air gap,
a total available magnetic air gap height comprising the upper and lower magnetic air gaps, and
a magnet providing magnetic flux over the upper magnetic air gap in a first direction and magnetic flux over the lower magnetic air gap in a second direction opposite the first direction; and
(b) a voice coil assembly including,
a bobbin,
an upper voice coil having windings coupled to the bobbin,
a lower voice coil having windings coupled to the bobbin, and
a total available voice coil height comprising the upper and lower voice coils;
(c) wherein the upper and lower voice coils are coupled to the bobbin at respective positions such that BOTH,
less than 100% of the total available magnetic air gap height contains voice coil windings, AND
less than 100% of the total available voice coil height is within the magnetic air gaps;
a second top plate defining a second upper magnetic air gap above the upper magnetic air gap;
a second bottom plate defining a second lower magnetic air gap below the lower magnetic air gap;
the at least one magnet further providing magnetic flux over the second upper magnetic air gap in the first direction and magnetic flux over the second lower air gap in the second direction.

16. The electromagnetic transducer of claim 15 wherein:
magnetic flux density over the upper magnetic air gap is substantially equal to magnetic flux density over the second upper magnetic air gap.

17. The electromagnetic transducer of claim 15 further comprising:
an upper magnet magnetically coupled between the top plate and the second top plate; and
a lower magnet magnetically coupled between the bottom plate and the second bottom plate.

18. The electromagnetic transducer of claim 17 wherein:
the at least one magnet, the upper magnet and the lower magnet have their magnetic polarity in a same orientation.

19. An audio speaker comprising:
(a) a basket;
(b) a motor structure coupled to the basket and including,
at least one push-pull magnetic circuit each including,
a top plate defining an upper magnetic air gap, and
a bottom plate defining a lower magnetic air gap; and
(c) a diaphragm assembly coupled to the basket and including,
a diaphragm,
a bobbin coupled to the diaphragm, and
a pair of voice coils coupled to the bobbin for each of the push-pull magnetic circuits, wherein the voice coils are coupled to the bobbin at positions such that the voice coils extend axially inward from their corresponding plates;
(d) wherein, within a linear travel region of the audio speaker, in each of the push-pull magnetic circuits,
in a push side, only a portion of one of its magnetic air gap and its voice coil is actively engaged with the other first one having a height that is shorter than or equal to a height of the second one,
in a pull side, only a portion of one of its magnetic air gap and its voice coil is actively engaged with the other one having a height that is shorter than or equal to a height of the other, and
a cumulative height of the portions is substantially equal to 50% of a cumulative total height of the ones that are actively engaged with the others.

20. The audio speaker of claim 19 wherein:
the voice coils are semi-overhung; and
the one-way linear travel is substantially equal to a height of a voice coil minus half a height of its corresponding plate.

21. The audio speaker of claim 19 wherein:
the voice coils are semi-underhung; and the one-way linear travel is substantially equal to a height of a plate minus half a height of its corresponding voice coil.

22. The audio speaker of claim 19 wherein the motor structure has an external magnet geometry.

23. The audio speaker of claim 19 wherein the motor structure has an internal magnet geometry.

24. The audio speaker of claim 19 further comprising:

a suspension component coupled to an end of the bobbin which is opposite the diaphragm.

25. The audio speaker of claim 24 wherein:

the diaphragm comprises a rigid planar diaphragm.

26. An apparatus comprising:

a moving magnet motor structure including, a yoke, a push-pull magnetic circuit having an upper plate and a lower plate magnetically coupled to opposite sides of a magnet, the upper plate and the lower plate defining an upper magnetic air gap and a lower magnetic air gap, respectively, between themselves and the yoke, and an upper voice coil and a lower voice coil coupled to the yoke, wherein, at a resting postion the upper voice coil and the upper magnetic air gap are partially engaged such that only part of each is engaged with the other, and the lower voice coil and the lower magnetic air gap are partially engaged such that only part of each is engaged with the other; and a bobbin coupled to, the upper plate, the magnet, and the lower plate.

27. The apparatus of claim 26 further comprising:

a body coupled to the motor structure and having an interior space into which the bobbin extends;

a suspension component coupled to an interior surface of the body and to a lower end of the bobbin which extends out of the motor structure.

28. The apparatus of claim 26 further comprising:

a diaphragm coupled to the bobbin.

29. The apparatus of claim 26 further comprising:

a body coupled to the motor structure;

a suspension component coupled to the body and to a lower end of the bobbin which extends out of the motor structure.

30. The apparatus of claim 26 configured to operate as a linear actuator.

31. The apparatus of claim 30 wherein the linear actuator comprises a vibrator.

32. The apparatus of claim 30 wherein the linear actuator comprises a vibration cancellation device.

33. The apparatus of claim 30 wherein the moving magnet configuration is an external moving magnet configuration.

34. A method of operating an electromagnetic transducer, the method comprising:

conducting magnetic flux over an upper magnetic air gap in a first direction and over a lower magnetic air gap in second direction opposite the first direction, in a push-pull magnetic circuit;

conducting at least one alternating current electrical voice signal through a pair of voice coils disposed within the magnetic circuit and including an upper voice coil having windings disposed in the upper magnetic air gap and a lower voice coil having windings disposed in the lower magnetic air gap;

continuing to move the voice coils until at least one of them enters one of, (a) a braking magnetic air gap which is not in the push-pull magnetic circuit, and (b) the magnetic air gap in which the other of the voice coils resides during linear travel of the electromagnetic transducer;

wherein, at a centered position of the voice coils with respect to the push-pull magnetic circuit, BOTH (1) less than 100% of each magnetic air gap contains voice coil windings, AND (2) less than 100% of each voice coil's windings are in its respective magnetic air gap; and in response to the alternating current electrical voice signal, moving the voice coils until exactly one voice coil and its magnetic air gap are inactive.

* * * * *